United States Patent [19]

Congdon

[11] Patent Number: 4,546,459

[45] Date of Patent: Oct. 8, 1985

[54] METHOD AND APPARATUS FOR A PHASED ARRAY TRANSDUCER

[75] Inventor: John C. Congdon, Fort Wayne, Ind.

[73] Assignee: Magnavox Government and Industrial Electronics Company, Fort Wayne, Ind.

[21] Appl. No.: 446,330

[22] Filed: Dec. 2, 1982

[51] Int. Cl.[4] ..... H04R 17/00

[52] U.S. Cl. ..... 367/155; 367/157; 367/159; 367/165

[58] Field of Search ..... 367/153, 155, 157, 159, 367/162, 164, 165, 912, 150; 181/144, 153, 267, 156, 157, 106

[56] References Cited

U.S. PATENT DOCUMENTS

| | | | |
|---|---|---|---|
| 3,141,148 | 7/1964 | Hueter . | |
| 3,191,143 | 6/1965 | Pardue . | |
| 3,191,144 | 6/1965 | Pardue . | |
| 3,213,414 | 10/1965 | Moser | 181/106 |
| 3,264,604 | 8/1966 | Bartlett . | |
| 3,309,653 | 3/1967 | Martin et al. . | |
| 3,325,779 | 6/1967 | Supernaw et al. | 367/151 |
| 3,363,228 | 1/1968 | Massa . | |
| 3,372,370 | 3/1968 | Cyr . | |
| 3,432,000 | 3/1969 | Ongkiehong et al. | 367/159 X |
| 3,444,508 | 5/1969 | Granfors et al. . | |
| 3,504,757 | 4/1970 | Chapman . | |
| 3,559,162 | 1/1971 | Ganfors et al. | 367/164 |
| 3,659,258 | 4/1972 | Abbott . | |
| 3,660,809 | 5/1972 | Pearson . | |
| 3,839,698 | 10/1974 | Ehrlich | 367/155 |
| 4,072,871 | 2/1978 | Wilson | 367/155 X |
| 4,268,912 | 5/1981 | Congdon . | |

OTHER PUBLICATIONS

Robertson, *Microphones,* 2nd Ed., London Life Books, 1963, pp. 5, 7–12, 130–133, 158–165, 200–285.

*Primary Examiner*—Harold J. Tudor

*Attorney, Agent, or Firm*—Thomas A. Briody; William J. Streeter; Richard T. Seeger

[57] ABSTRACT

A stacked phased array type of transducer has a single electroacoustic transducer element supported intermediately of an elongated tube having a plurality of ports and an end wall at each end thereof for transmitting and receiving acoustic waves broadside the longitudinal axis of the array tube. The element has a first vibratile surface in direct acoustical communication with the external transmission medium and a second vibratile surface in direct acoustical communication with the tube internal transmission medium. The tube is provided with at least one annular port spaced longitudinally from each end of the element for providing acoustic coupling between the internal and external transmission mediums with the tube interior providing acoustic transmission paths internally of the tube communicating between the second vibratile surface and the external transmission medium at each one of the ports. The physical spacing of the ports, the aperture area of the ports, the effective acoustical wave path length internally of the tube, and the acoustical impedance of the end walls of the tube are configured to provide predetermined phase shift and acoustic transmission characteristics of the transmission paths between the second vibratile surface of the transducer element and the external transmission medium immediately adjacent each port to provide a maximum acoustic wave pattern broadside or perpendicular to the longitudinal axis of the tube. Baffles are provided to phase shift control the acoustical wave internally of the tube. In an embodiment transducer elements and ports are alternately positioned along the tube length.

62 Claims, 32 Drawing Figures

FIG. 5B
FIG. 5C
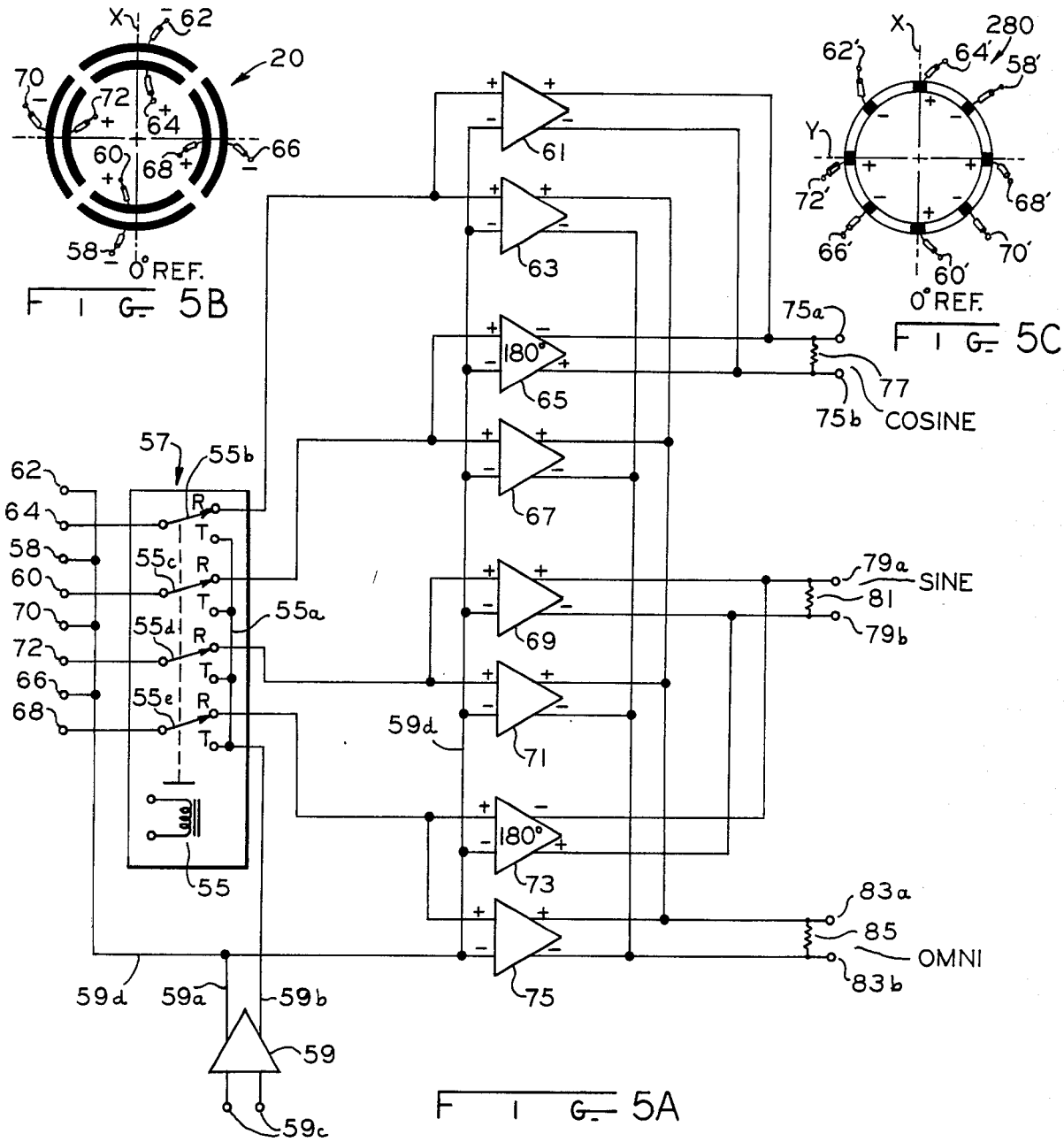
FIG. 5A
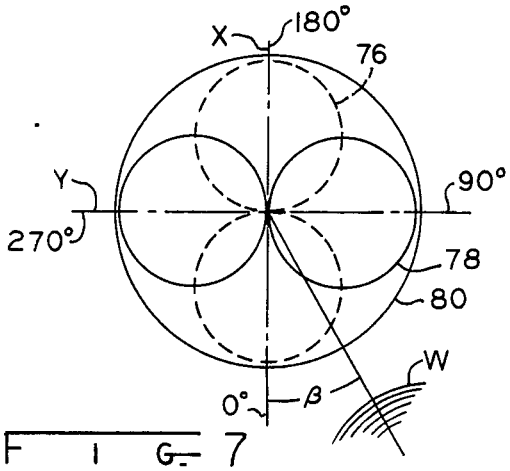
FIG. 7
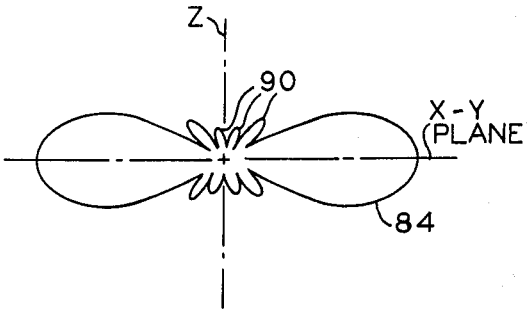
FIG. 8

METHOD AND APPARATUS FOR A PHASED ARRAY TRANSDUCER

BACKGROUND OF THE INVENTION

1. Field of the Invention

The present invention relates to an electroacoustic transducer and more particularly to an improved cylindrically configured phased array transducer for transmitting and receiving acoustic signals.

2. Description of the Prior Art

Acoustical transducer arrays comprising a number of individual cylindrical electroacoustic transducer elements, typically arranged in axial alignment, for providing predetermined radiation and response patterns are well known and are used to a considerable extent in both active and passive sonar and sonobuoy systems. Transducer arrays which operate to provide a directional acoustical radiation and response pattern in a vertical plane or in a plane containing the longitudinal axis of the array are advantageously used in such systems since they can provide greater radiated acoustical energy and/or improved receiving sensitivity, in directions broadside the array, i.e. substantially perpendicular to the array axis, in the vertical plane, with an accompanying improvement of detected signal to noise ratio. Broadside vertical pattern directivity can also provide a reduction in undesired effects caused by acoustic reflections transmitted and/or received from the top and bottom surfaces of the water body in which the array is operated.

The basic criteria for broadside acoustic beam forming is well known in the art and in general requires a predetermined number of individual active transducer elements spaced apart predetermined distances and operated at predetermined relative amplitudes and phases for providing a desired directivity. In prior in-line or stacked multielemement arrays the relative amplitude and phasing of the individual transducer elements are generally obtained by electrical circuit means while maintaining the predetermined physical spacing of the elements. In such prior art arrays using piezoelectric transducer elements amplitude control or amplitude shading of the elements are also obtained by adjusting the electrode area of the various elements.

Numerous underwater detection systems exist which utilize electroacoustic transducer element arrays having both vertical and horizontal directivity patterns. One such prior art transducer array provides vertical directivity in combination with a directional and an omnidirectional horizontal pattern and comprises a number of individual vertically stacked hollow cylindrical shaped piezoelectric electroacoustic transducer sections or elements. Each one of the elements is in itself an active piezoelectric electroacoustic transducer element. Certain of these individual elements are polarized and provided with electrodes so as to provide a directional horizontal pattern while others are polarized and electroded to provide an omnidirectional horizontal pattern. Broadside vertical directivity of this prior art array is provided by proper electrical phasing and physical spacing of the respective individual directional and omnidirectional transducer elements.

Directional pattern symmetry of these prior art arrays require exacting uniformity of not only the homogeneity and physical dimensions of the piezoelectric material, but also of the manufacturing processes involved for each one of the individual transducer elements used in the array. This required matching of the individual piezoelectric elements is especially critical in multielement arrays which provide both broadside vertical directivity and omnidirectional and sine-cosine like horizontal directivity patterns for use in detection systems which use electrical output signals from the array to compute target bearing information. In addition, when uniformity between a number of individual transducer arrays of the same type is required, these control and matching problems, become even more severe. This inherent matching requirement of these prior art multielement stacked arrays and the relatively large amount of piezoelectric material required to manufacture a single transducer array results in an array of relatively high unit cost. When these prior art multielement arrays are used in an expendable and high value engineered sonobuoy, the cost of the array can represent a sizeable amount of the total cost of the sonobuoy. Also, the arrays are relatively heavy due to the number of piezoelectric elements required.

SUMMARY OF THE INVENTION

It is an object of the present invention to provide a phased array electroacoustic transducer having broadside vertical directivity which is inexpensive to manufacture relative to the cost of comparable prior art multielement transducer arrays.

It is a further object to provide in the array of the previous object a combination of active electroacoustic transducer elements and acoustic coupling ports where the ports effectively act as active elements in the array.

It is another object of the present invention to provide a phased array transducer having a hollow cylindrically or tubularly configured body and having a plurality of acoustic coupling ports and a single electroacoustical transducer element operating in combination with the ports for providing a broadside vertical directivity pattern.

It is an object of the present invention to provide an improved phased array electroacoustic transducer having broadside vertical directivity which is especially suited for use as a hydrophone for receiving underwater acoustic signals and as a projector for transmitting underwater acoustic signals.

It is another object of the present invention to provide a phased array transducer which is lightweight, easily packaged and deployed and suitable for use in sonobuoys.

It is yet another object of the present invention to provide a phased array underwater transducer which performance is not affected by hydrostatic pressure.

It is a further object of the present invention to provide a phased array transducer using a single active transducer element and having a reinforced broadside directional response pattern in the vertical plane and omnidirectional and/or directional response patterns in the horizontal plane.

Another object of this invention is to provide a filter having at least one perforated plate to phase shift control an acoustic wave.

A further object of the present invention is to provide a phased array electroacoustic transducer having an elongated tube in which electroacoustic transducer elements and acoustic coupling ports are alternately positioned in the longitudinal direction.

In brief one embodiment of the phased array transducer of the present invention comprises a single electroacoustic transducer element supported intermediately of an elongated tube having a wall at each end thereof. The element has a first vibratile surface in direct acoustical communication with an external transmission medium and a second vibratile surface in direct acoustic communication with a transmission medium internally of the tube. The tube has a plurality of annular ports for providing acoustic coupling between the internal and external transmission mediums. The ports are spaced longitudinally from the transducer element and the end walls of the tube. Acoustic transmission paths are provided internally of the tube for communicating between each one of the ports and the second vibratile surface of the transducer element. The physical spacing of the ports, the aperture area of the ports, the effective acoustical wavelengths of the internal transmission paths, and the acoustical impedance of the end walls of the tube are configured to provide a predetermined acoustic wave phase shift and amplitude attenuation or acoustic transmission characteristic between the second vibratile surface of the transducer element and the external transmission medium immediately adjacent each port.

In operation each port acts similarly to an individual active transducer element of a prior multielement array for providing broadside vertical directivity. In transmission of acoustic waves, an internal wave generated by the second vibratile surface of the transducer element and appearing at and radiated from each port combines in the external transmission medium with the wave radiated from the first or external surface of the transducer element to form a resultant reinforced or maximum acoustic wave radiation in a direction broadside the longitudinal axis of the array or tube and a minimal radiation in directions substantially in line with the array axis. In reception of acoustic waves radiated from a remote spatial acoustic source, the above combination process is reversed providing a resultant output signal from the transducer element which is a maximum for acoustic waves arriving from sources located broadside the longitudinal axis and minimum from sources located in line with the array axis. The transducer element can also be configured to provide predetermined planar type sine and/or cosine like and omnidirectional radiation and response patterns in a plane substantially perpendicular to the longitudinal axis for use in transmitting and/or receiving acoustic waves, thus in reception of acoustic waves radiated from a remote spatial acoustic source, there can be provided a resultant output signal from the transducer element which varies as a function of the direction of arrival relative to the predetermined directional patterns in the horizontal plane.

In accordance with one embodiment of the present invention for operation in an underwater environment, there is provided a hollow elongated cylindrical tube having closed ends and a plurality of pairs of substantially annular apertures or ports through the wall of the tube and spaced along the longitudinal dimension of the tube. The apertures provide for internal flooding of the tube with the external or water acoustic transmission medium upon immersion of the tube, and also provide acoustic coupling ports between the internal transmission medium in the tube and the transmission medium external to the tube. The tube is adapted to receive intermediately of the ports of each pair of coupling ports a hollow cylindrical piezoelectric transducer element having electrodes on the inside and outside vibratile walls and polarized to vibrate in a radial mode. The inside and outside vibratile walls of the element are in acoustical communication with the internal and external transmission mediums, respectively. The ports are located predetermined distances from the transducer element and respective ends of the tube to provide a reinforcement of radiated acoustical energy in the external transmission medium in a direction broadside the tube.

In another embodiment of the invention, the cylindrical elongated tube is adapted to be suspended underwater in a vertical attitude and the cylindrical piezoelectric transducer element has attached to its surfaces a plurality of spaced electrodes for additionally providing in the horizontal plane a sine/cosine like and/or omnidirectional pattern. A partitioning baffle is provided inside the cylindrical transducer element for diametrically subdividing the internal volume into four equal (pie-shaped) sections, each one of the volume sections acoustically communicating with the transmission medium within the tube and each one of the sections physically related to a different quadrant of the sine/cosine like directional pattern. The partitioning baffle results in improved acoustic loading and coupling of the element to the internal transmission medium with an accompanying improvement in the horizontal directional pattern of the array.

In yet another embodiment of the present invention a means is provided for deploying the cylindrical transducer element from a stored or packaged position to an operating position relative to the cylindrical tube.

In one embodiment of the present invention, the length of the internal acoustic transmission path between the transducer element and the port nearest the end of the tube was increased in length by coaxial placement within the tube of a rimmed chimney-shaped baffle. This allows adjustment of acoustic path length and resultant phase shift of the internal transmission path without affecting physical placement of the port relative to the transducer. Similar baffles can also be used in the internal transmission paths associated with the other ports.

In still another embodiment, the rimmed chimney shaped baffle is replaced with a plurality of flat and relatively thin perforated circular baffle plates each plate having a plurality of small holes of diameters much less than a wavelength of the acoustic wave passing therethrough. The plates are attached at their outer peripheral edges to the inside surface of the cylindrical elongated tube and spaced apart in the internal acoustic wave transmission path between a given pair of adjacent ports. The plates operate to provide a low pass acoustic wave filter and provide a substantially reduced phase shift between the adjacent ports at a selected frequency in the operational frequency range of the transducer array.

The present invention utilizes much the same basic criteria for providing broadside vertical directivity as was previously mentioned for prior art arrays using a plurality of individual active transducers, i.e. predetermined spacing of the transducer elements and operation of these elements at relative predetermined phases and amplitudes. In these prior art arrays the relative phasing and amplitude of these transducer elements are generally controlled by electric circuit means whereas in the present invention the single transducer element and the ports are substantially equivalent to the active transducer elements of the prior art arrays in relation to their operation for beam forming or providing vertical directivity, and the control of phase and amplitude is by acoustic means. In the present invention the acoustic transmission path between the transducer and each one of the ports can be adjusted in effective acoustic length to control phase shift of the respective paths. The actual length of the path can be adjusted by baffles or other means and/or the internal transmission medium or parts thereof can be selected to alter the velocity in the transmission path and hence the phase shift between, for example, the transducer and a given port. When the internal and external mediums are different fluids, the ports are covered by acoustically transparent membranes to maintain transmission medium and internal medium separation. Such changes in the phase shift characteristics of the internal transmission paths allow adjustment of the port phase while maintaining a desired port location along the longitudinal dimension of the tube relative to the locations of the transducer element. Phase shift and amplitude at a given port can be adjusted by phase shift control perforated plates, baffle walls, proper longitudinal placement of the tube end walls and by selection of acoustic surface impedance of the end walls which controls absorption or reflection characteristics of the end walls and thus standing waves within the tube. The aperture area of each port can be adjusted in size to control the effective acoustic coupling between the internal and external transmission mediums which in effect provides amplitude control at the port. In general it is desired that internal acoustic waves from the transducer element and arriving and radiated at the immediate external surface plane of the ports be substantially in phase with the acoustic waves radiated from the transducer element at the external surface plane. The relative amplitudes of these radiated waves are, as in the prior art arrays, adjusted to provide a desired shading of the ports for reducing radiation or response in directions along the axis of the array, i.e. reduction of the side lobes of the main beam broadside the array in the vertical plane.

This invention also provides a phased array electroacoustic transducer having a broadside pattern wherein the array has a combination of active electroacoustic transducer elements and acoustic coupling ports. In one embodiment active elements and passive ports are alternated along a tube length with the ports acting as active elements.

These and other objects and advantages will become more apparent when embodiments of this invention are disclosed in connection with the drawings, briefly described as follows.

BRIEF DESCRIPTION OF THE DRAWINGS

FIG. 5*a* is a connection diagram for the leads of the transducer element of FIGS. 5 and 21 to obtain sine, cosine and omnidirectional acoustical wave patterns;

FIG. 5*b* is a simplified cross sectional view similar to that of FIG. 5;

FIG. 5*c* is a simplified cross sectional view of the transducer element of FIG. 21;

FIG. 7 shows typical sine/cosine like directional field patterns and a typical omnidirectional field pattern which patterns are capable of being provided by the present invention in a plane containing the X and Y axes;

FIG. 8 shows a typical directional field pattern in a plane containing the Z axis and generated broadside of the Z axis and capable of being provided by the present invention in conjunction with the field patterns of FIG. 7;

DESCRIPTION OF THE PREFERRED EMBODIMENTS

Figure 1:
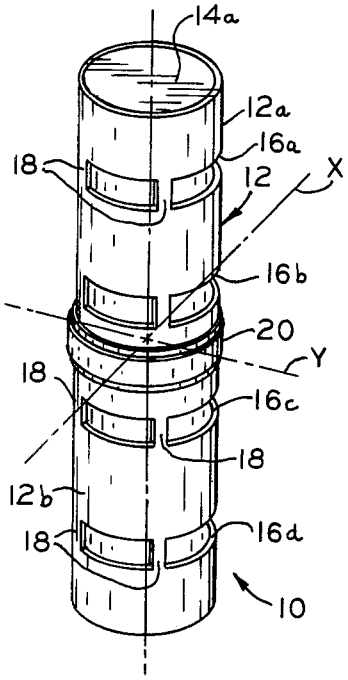
FIG. 1 is a view in perspective of one embodiment of a phased array transducer in accordance with the present invention.

In the following descriptions and accompanying drawing figures of the present invention, like reference characters designate like parts and functions throughout.

Although the present invention is intended primarily for transmitting and/or receiving underwater acoustic signals or sound waves, other uses will be apparent to those skilled in the art. In general, the present invention pertains to a transducer array which comprises a single electroacoustic transducer element and an elongated cylindrical enclosure or tube having a longitudinal axis and a plurality of annular acoustic ports for providing a directional and/or an omnidirectional acoustical field pattern in a plane perpendicular to the longitudinal axis, as shown in FIG. 7, and a reinforced directional field pattern in a plane parallel to or containing the longitudinal axis, as shown in FIG. 8, which figures will be referenced and described in more detail hereinafter. The field patterns in FIGS. 7 and 8 correspond to the horizontal and vertical planar field patterns, respectively, when the attitude of longitudinal axis of the array enclosure or tube is vertical as would be a typical operating attitude when the transducer array is used as a sonobuoy hydrophone for transmitting and/or receiving underwater signals. It should be understood that these field patterns represent both the transmitting and receiving directional properties of the transducer array since the arrays of this invention in general are reciprocal. It should be understood that the use herein of the word hydrophone implies a transducer for transmitting and/or receiving acoustic signals and such use thus applies to both projectors and/or hydrophones.

Figure 2:
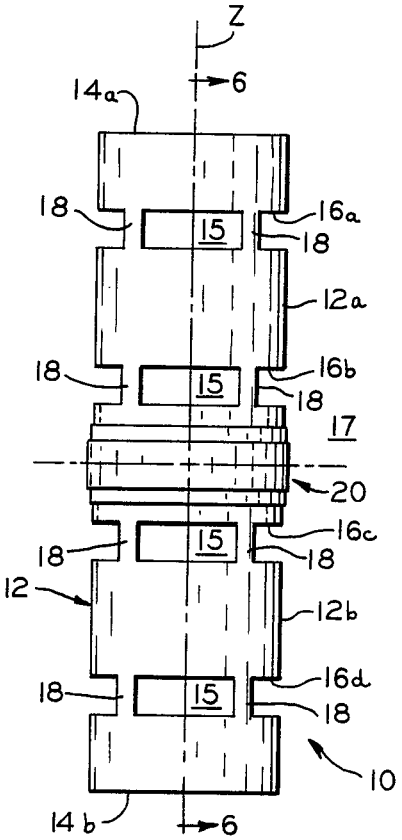
FIG. 2 is a side elevation view of the embodiment shown in FIG. 1.
Figure 3:
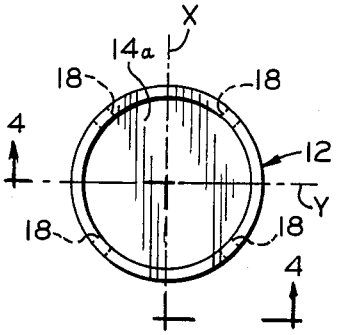
FIG. 3 is a top plan view of the phased array transducer shown in FIGS. 1 and 2.

Referring now to FIGS. 1, 2, and 3 there are shown a pictorial, side, and top views respectively of a phased transducer array 10 in accordance with the present invention. The transducer array 10 comprises an elongated cylindrical tube 12 of a suitable material such as a metal or a rigid plastic and has suitable longitudinal and diameter dimensions depending on the desired acoustical frequency range and desired beam pattern for which transducer array 10 is designed. It is preferred that tube 12 material have a low acoustic transmissivity, high insensitivity to acoustic vibrations, and low acoustic absorption. Aluminum has been used as a tube material. Tube 12 has ends 14*a*, 14*b* at the upper and lower ends, respectively, thereof and a plurality of substantially annular apertures or ports 16*a*, 16*b*, 16*c*, 16*d* formed in the wall of tube 12 at predetermined longitudinally spaced apart locations along the length dimension of tube 12. Apertures 16*a*–16*d* each provide an acoustic coupling port between the internal transmission medium 15 internally of tube 12 and the external transmission medium 17 externally of tube 12. Ports 16*a*–16*d* are each formed of four equal arcuate apertures separated by longitudinal struts or ribs 18 which join portions of tube 12 above and below ports 16*a*–16*d* to provide longitudinal structural integrity of tube 12. Ribs 18 are preferably made as thin as possible in the circumferential direction and still maintain the structural rigidity of tube 12. Also, it is preferable that ribs 18 are equally spaced about the circumference of their respective ports to achieve wave pattern symmetry. The width of ribs 18 in the circumferential direction should be enough to provide structural integrity of tube 12 and to offer a means of uncoupling adverse resonances in the tube 12. However, the width should be small compared to the wavelength of the acoustic wave in the medium so that the ribs 18 do not limit the transmission of the acoustical wave through a port aperture and do not interfere with the incoming wave when the transducer array 10 is receiving and forming sine and cosine like directivity patterns in the X-Y plane. For example, a ratio of rib width to wavelength of 1:15 is acceptable. Also a ratio of rib width to one-quarter of tube 12 circumference of 1:6 was found to be acceptable. These ratios are a good compromise of acoustic performance and structural integrity of tube 12. Tube 12 comprises an upper elongated portion 12*a* and a lower elongated portion 12*b*. A hollow cylindrical or ring electroacoustical transducer element 20 is supported between portions 12*a*, 12*b*.

Figure 4:
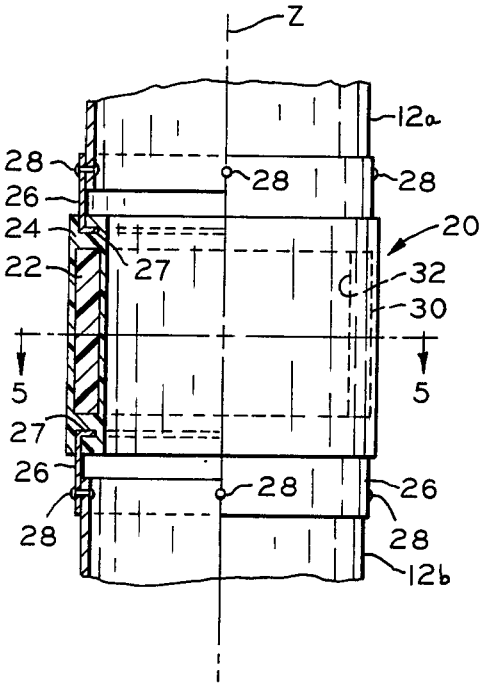
FIG. 4 is an enlarged partial quarter sectional view of the transducer element portion of the transducer shown in FIGS. 1, 2, and 3 taken along the lines 4—4 of FIG. 3.
Figure 5:
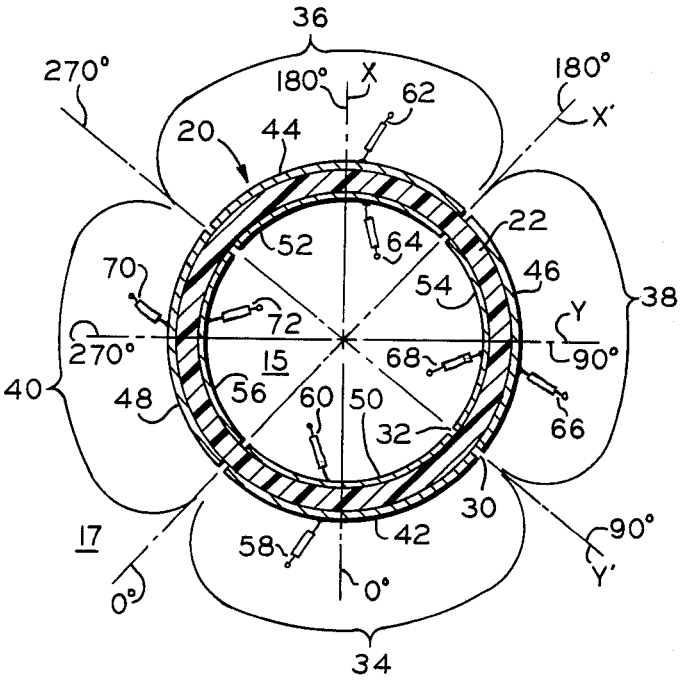
FIG. 5 is an enlarged partial cross sectional view of the transducer element taken along the lines 5—5 in FIG. 4.

Referring to FIGS. 4 and 5, element 20 comprises a hollow cylinder or ring 22 of an electroacoustic material such as piezoelectric material polarized to vibrate in a radial mode although other vibrational modes and types of electroacoustic transducer material can be used. A typical piezoelectric material is lead zirconate titanate. Element 20 is embedded or encapsulated in a suitable encapsulating material 24 such as an elastomeric or polymeric material which can be cast or molded about element 20. Also embedded in material 24 and concentrically positioned with and longitudinally spaced apart from each end edge of element 20 is a cylindrical mounting ring bracket 26 which brackets 26 are in turn affixed to portions 12*a*, 12*b* by arcuately spaced rivets 28 or other suitable fastening means such as, for example, machine screws or an epoxy adhesive. Material 24 provides mechanical support for element 20, is acoustically transparent to provide relatively good acoustical coupling between element 20 and mediums 15, 17, and aids in minimizing direct transmission of acoustic vibrations between element 20 and tube portions 12*a*, 12*b*, which vibrations degrade the performance of the transducer array. The longitudinal spacing between brackets 26 provides a window area or port 27 for transmission of acoustic waves to and from element 20. Since the present invention is intended primarily for use in underwater applications, protection of the transducer element 20, and its electrodes, later described, from their environment is important and is provided by the encapsulating material 24. Material 24 can be comprised of layers or a combination of different materials to provide the above properties.

Referring to FIG. 5, in which material 24 has been omitted for purposes of clarity, piezoelectric ring 22 has outer vibratile surface 30 and inner vibratile surface 32. Ring 22 is comprised of quadrants 34, 36, 38, 40, having outer electrodes 42, 44, 46, 48, respectively, affixed in conventional manner to outer surface 30 and inner electrodes 50, 52, 54, 56 respectively, affixed in conventional manner to inner surface 32. Thus, electrode pair 42, 50 is in quadrant 34; electrode pair 44, 52 is in quadrant 36; electrode pair 46, 54 is in quadrant 38; and electrode pair 48, 56 is in quadrant 40. Each electrode covers substantially all of its respective quadrant and is spaced from the adjacent electrode on either arcuate side to prevent electrical communication with any other electrode. The electrodes are applied to their respective surfaces 30, 32 in a manner known to the art such as vapor deposition and are of a conductive material such as silver. Electrical leads 58, 60, 62, 64, 66, 68, 70, 72 are electrically coupled to electrodes 42, 50, 44, 52, 46, 54, 48, 56, respectively. Electrodes 42–56 are encapsulated in material 24. Leads 58–72 provide connections between their respective electrodes and external utilization circuitry.

As will be apparent to those skilled in the art, in the receiving mode of transducer array 10, planar response patterns for use in determining directivity of a received acoustical signal can be provided by connections as will be explained for FIGS. 5*a*–5*c*. The difference in relative output signals from the electrode pair for opposite quadrants 34, 36 will provide a measure of the pressure gradient existing diametrically across the element 20 and will be maximum for acoustic wavefront travel in a direction along the X axis and minimum for wavefront travel in a direction along the Y axis thus providing a cosine-like directional field pattern such as shown by dashed line 76 of FIG. 7. Likewise, the difference in output signals of the electrode pair for opposite quadrants 38, 40 provides the sine-like field pattern shown by solid line 78 of FIG. 7, being maximum for a received wavefront along the Y axis and minimum for a received wavefront along the X axis. As used herein, the terms "sine" and "cosine" patterns refer in general to sine-like and cosine-like patterns since the actual patterns obtained may vary from exact sine and cosine patterns.

Adding or averaging of the output signals from all four electrode pairs from all four quadrants 34, 36, 38, 40 will provide an omnidirectional field pattern as shown by line 80 in FIG. 7. Other patterns, such as cardioid patterns, can be obtained as is known in the art. In the transmitting mode of transducer array 10, properly phased electrical signals can be applied to the corresponding quadrant electrode pairs of element 20 to generate an omnidirectional or directional acoustical wave patterns as may be desired. Various of the electrodes can for example be connected together or combined to form a single continuous outer electrode and in a like manner, and in lieu thereof, the inner electrodes can be connected in common or made a single continuous inner electrode.

Although the herein phased array transducer can provide horizontal directional patterns for both transmitting and receiving acoustic wave signals, the directional transmitting properties are not generally required when the transducer array is used in typical sonobuoy applications. As examples, in a passive type sonobuoy which operates to provide only the reception of acoustic signals, the transducer array would normally operate in the receive mode to provide desired horizontal directional and/or omnidirectional receiving patterns. In an active type sonobuoy which operates to provide both the transmission and reception of acoustic signals, the transducer array would normally operate to provide an omnidirectional pattern in the transmit mode while providing the desired directional and/or omnidirectional horizontal patterns in the receiving mode.

Referring now to FIG. 5A, there is shown a schematic circuit for electrically combining the output signals of, or input signals to, transducer element 20, the electrodes and leads of which are shown in section in FIG. 5B, and transducer element 280, the element sections, electrodes, and leads of which are shown in section in FIG. 5C. FIG. 5A is a connection diagram having a transmit/receive relay 57 for providing sine, cosine like, and omnidirectional receiving patterns and for transmitting an omnidirectional pattern. As will become apparent, sine and cosine patterns can be transmitted by reversing the amplifiers, making appropriate relay 57 connection changes and applying transmit signals to terminals 75*a*, 75*b*, 79*a*, 79*b*, in the circuit of FIG. 5A. The + (plus) and − (minus) signs shown on the various indicated leads of the schematic indicate relative voltage polarities when each transducer quadrant is separately subjected to a given identical mechanical movement or stress. The combining circuit of FIG. 5A provides a mathematical combining and averaging of the individual transducer element quadrant outputs to provide simultaneous cosine like, sine like and omnidirectional pattern signals.

Electrode leads 60, 64, 68, 72, FIG. 5B, are electrically connected to their respective electrodes as previously described and are each coupled to transmit/-receive relay 57. Electrode leads 58, 62, 66, 70 are electrically coupled to terminal 59*a* of power amplifier 59 and the common input terminals of each of the amplifiers 61, 63, 65, 67, 69, 71, 73, and 75 by common bus 59*d*. Electrode leads 58′–72′, FIG. 5C, are electrically connected to their respective electrodes 284, 286 which will be described later in connection with tangentially polarized transducer element 280 in FIG. 21. For use with element 280, leads 60′, 64′, 68′, 72′ would each be connected to relay 57 instead of leads 60, 64, 68, 72 respectively and leads 58′, 62′, 66′, 70′ would be electrically connected to common bus 59*d* instead of leads 58, 62, 66, 70, respectively.

Terminal 59*b* of power amplifier 59 is electrically coupled to transmit bus 55*a* in relay 57. Single pole double throw switches 55*b*–55*e* of relay 57 have their poles electrically coupled to leads 64, 60, 72, 68 respectively and each switch 55*b*–55*e* of relay 57 has a receive terminal R and a transmit terminal T. The blades of relay switches 55*b*–55*e* are ganged and mechanically coupled to and operated by solenoid or electromagnetic coil 55. The switch blades are shown in the deactivated condition of relay coil 55. Activation of coil 55 will cause each one of the switch blades to electrically switch from the respective R or receive terminals to the T or transmit terminals. Other means such as a solid state switching device can be used in place of relay 57.

Amplifiers 61, 63, 67, 69, 71, 75 are essentially zero phase shift amplifiers and amplifiers 65, 73 are essentially 180° phase shift amplifiers or inverters. Each one of the amplifiers may have a gain greater or less than one as may be desired for signal amplification and/or signal level compensation purposes, as is well known in the art. It is preferred that the gain of all amplifiers be identical when the sensitivities of all transducer quadrants are identical. The gain of each of these amplifiers may, however, be adjusted or varied in order to compensate for any differences which might exist in the sensitivities of the different transducer quadrants. Receive terminal R for switch 55*b* is electrically connected to the + terminals of amplifiers 61, 63; terminal R for switch 55*c* is electrically coupled to the + terminals of amplifiers 65, 67; terminal R for switch 55*d* is electrically coupled to the + termninals of amplifiers 69, 71; and terminal R for switch 55*e* is electrically coupled to the + terminals of amplifiers 73, 75.

The transmit terminal T of each switch 55*b*–55*e* is electrically connected to bus 55*a*. The − input terminal of each amplifier 61–75 is electrically coupled to common bus 59*d*; the + output terminal of amplifier 61 and the − output terminal of inverter amplifier 65 are electrically coupled to cosine output terminal 75*a*; the − output terminal of amplifier 61 and the + output terminal of amplifier inverter 65 are electrically connected to cosine output terminal 75*b*; the + output terminal of amplifier 69 and the − output terminal of amplifier inverter 73 are electrically connected to sine output terminal 79*a*; the− output terminal of amplifier 69 and the + output terminal of amplifier 73 are electrically connected to sine output terminal 79*b*; the + output terminal of each of amplifiers 63, 67, 71, 75 is electrically connected to omnidirectional output terminal 83*a*; and the − output terminal of each of amplifiers 63, 67, 71, 75 is electrically connected to omnidirection output terminal 83*b*. Resistance 77 is electrically connected across sine output terminals 75*a*, 75*b*; resistance 81 is electrically connected across sine output terminals 79*a*, 79*b*; and resistance 85 is electrically connected across omnidirection output terminals 83*a*, 83*b*. Resistors 77, 81, and 85 provide resistive output loads to their respective amplifiers.

The electrical output signals from each one of the electroacoustic transducer quadrants associated with the respective electrode leads 58–72 are supplied as input signals to the combining circuit shown in FIG. 5A. Assuming relay 57 is in the receive position, as shown, hydrophone output signals developed at each one of the leads 58–72 are supplied to the input terminals of their corresponding amplifiers as previously described. The output terminals of amplifiers 63, 67, 71, 75 are connected in parallel and in turn are connected to the omnidirection signal output terminals 83*a*, 83*b* of the combiner. This parallel connection of the amplifier output terminals provides an averaging of the output signals from all of the element 20 quadrants for supplying an omnidirectional output signal at terminals 83*a*, 83*b*. If an omnidirectional signal output is not desired, the amplifiers 63, 67, 71, 75 may be omitted.

The output signals from transducer 20 quadrants associated with electrodes leads 72, 68 which are positioned in diametrically opposing quadrants of transducer element 20, such as are located along the Y axis, FIGS. 5B, 5C, are supplied as input signals to amplifiers 69, 73, respectively. In a like manner, the output of the transducer element 20 quadrants associated with electrode leads 64, 60 are supplied as input signals to amplifiers 61, 65, respectively. The outputs of amplifiers 69, 73 are connected in parallel and are in turn connected to the sine directional output terminals 79*a*, 79*b* of the combiner. Amplifiers 69, 73 thus provide an algebraic combination or difference of the output signals of the element 20 quadrants associated with leads 72, 68 for supplying a sine pattern directional output signal at terminals 79*a*, 79*b*. Amplifiers 61, 65 operate in a like manner using the output signals from the opposing quadrants of transducer element 20 associated with electrode leads 64, 60 located along the X axis to provide a cosine directional output signal at terminals 75*a*, 75*b*.

If it is desired to transmit an omnidirectional signal, then relay 57 is actuated to move the relay switch blades of relay 57 to the T terminals. When a signal is provided to the input terminals 59*c* of amplifier 59 it is amplified and provided at terminals 59*a*, 59*b* where it in turn is provided to leads 58–72 through relay switches 55*b*–55*e*. The signals at leads 58–72 then drive the associated element 20 quadrants to transmit an acoustic wave in the medium. If it is desired to transmit a sine and/or cosine pattern acoustic wave, then the amplifiers 61, 65, 69, 73 are reversed in amplifying direction and when input signals are applied to the cosine terminals 75*a*, 75*b* and/or the sine terminals 79*a*, 79*b*, they are amplified with a gain and power levels sufficient to drive the element 20 quadrants to transmit an acoustic signal in the medium. It will be apparent to those skilled in the art that to provide sine and/or cosine transmitted patterns the circuitry shown in FIG. 5A would have to be modified to provide proper switching of the input and output terminals or leads of the respective amplifiers during transmit and receive conditions or modes.

Connections of electrode leads 58–72 to obtain axes X′, Y′, FIG. 5, which are shifted 45° from axes X, Y respectively, can among other possible ways include connecting electrode leads 62, 64 in parallel with electrode leads 66, 68 respectively for a first half section and connecting electrode leads 70, 72 in parallel with electrode leads 58, 60 respectively for a second half section and connecting both half sections in combined series subtraction, or the signal outputs of the respective half sections otherwise combined to provide a resultant difference signal, in order to provide cosine response along the X′ axis. Likewise, electrode leads 62, 64 are connected in parallel with electrode leads 70, 72 respectively for a third half section and electrode leads 66, 68 are connected in parallel with electrode leads 58, 60 respectively for the fourth half section and the third and fourth half sections are combined in series subtraction, or the signal outputs of the respective half sections otherwise combined to provide a resultant difference signal, in order to provide sine response along Y′ axis (FIG. 5) as would be understood by one skilled in the art. The above described connections for providing the first half section-second half section combination and the third half section-fourth half section combination respectively would be made in a time sequenced fashion to provide first the cosine pattern and then the sine pattern alternately as would be understood by one skilled in the art.

Referring to FIGS. 1–8, the operation of transducer array 10 will be described. Transducer array 10 is reciprocal, i.e. it can transmit acoustic waves in the transmission medium from electrical input signals or it can receive acoustic waves in the transmission medium and convert them into electrical output signals. The receive mode of transducer array 10 will be described, it being understood that the operation in the transmit mode is the reciprocal or reverse thereof and the field pattern shown and described represent both the transmitting and receiving properties or capabilities of transducer array 10.

Transducer array 10 is typically suspended in a transmission medium, which is water when the transducer is used as a hydrophone, so that its longitudinal axis Z is vertical. When the direction of travel of acoustic wavefront W impinges transducer array 10 at an angle $\beta$ with axis X in the horizontal plane, it impinges the external surface of element 20, and also enters ports 16*a*–16*d* and the waves entering ports 16*a*–16*d* are phase shifted and then impinge the internal surface of element 20 to reinforce the vibrational effect on element 20 of wave W on the external surface of element 20. Thus a resultant electrical output signal having a relatively high signal to noise ratio is provided by the transducer array 10. The signal to noise ratio is increased since lobe 84 is relatively narrow in the vertical plane and side lobes 90 are suppressed thereby rejecting responses from directions other than the main lobe direction.

In the transmitting mode, the above is reversed and electrical signals are transmitted to element 20 causing surfaces 30, 32 to vibrate and generate acoustical waves in the respective coupled transmission mediums. The waves from internal surface 32 travel internally of tube 12 and exit ports 16*a*–16*d* with a phase and amplitude to reinforce the wave from external surface 30 in the desired direction of travel.

The required relative phasing, amplitude, and spacing of the individual transducer elements of a prior art multielement transducer array to provide a desired broadside directional pattern is well known in the art and for example is treated in "Fundamentals of Acoustics" by Kinsler and Frey, Second Edition published 1962 by John Wiley & Sons; "Theoretical Acoustics" by Morse and Ingard published 1968 by McGraw-Hill; and "Principles of Underwater Sound" by Urick published 1975 by McGraw-Hill. This prior art theory applies to the ported single element transducer array of this invention. Thus the advantages of the prior art multielement electroacoustic transducer array are obtained in the transducer array of the present invention having a single electroacoustic transducer element and a plurality of ports or alternating elements and ports.

In general, particle velocity of the acoustic wave at ports 16*a*–16*d* varies inversely with port aperture area, or longitudinal dimension of annular apertures of a given tube diameter. The particle velocity of the wave at an aperture is analogous to the velocity of the surface of a vibrating ceramic element of a prior art multielement transducer array. Internal wave phase at ports 16*a*–16*d* is dependent on the frequency of the acoustic wave, the nature of the internal transmission medium, and upon the effective length of the acoustical path between each port and surface 32. Where a band of frequencies is being transmitted, the center frequency of the band is conveniently used as the frequency of the acoustic wave and distances between ports and surfaces are conveniently measured between their respective longitudinal mid-points.

Surface 32 vibrates 180° out of phase with surface 30. Therefore, if reinforcing in-phase waves from surfaces 30, 32 are desired through ports 16*a*–16*d*, ports 16*b* and 16*c* each should have an effective acoustical path length of substantially one-half wavelength from surface 32, and ports 16*a*, 16*d* should have an effective acoustical path length of substantially one wavelength from ports 16*b*, 16*c* respectively except that slightly different path lengths may be desired to obtain phase shading as is known in the art. Each additional port formed in tube 12 would have an effective acoustical path travel of substantially one wavelength from the next closest port to surface 32 for an in phase wave at that port with the same exception for shading as mentioned above. Increasing the number of ports having substantially in-phase waves will reduce the beam width of lobe 84, FIG. 8, in the vertical plane. Increasing the number ports within a given length of tube 12 decreases the vertical beam width and the amplitude and phase shading the acoustical signal at the ports can control and reduce side lobes.

In the above, ports 16*a*–16*d* are substantially symmetrical in longitudinal spacing from element 20. Symmetrical spacing obtains lobe 84, FIG. 8, in a direction substantially perpendicular to Z axis. By making ports 16*a*–16*d* physically nonsymmetrical about element 20 along the longitudinal axis of tube 12, lobe 84 can be tilted upwardly or downwardly to a desired angle from the perpendicular or broadside direction from the Z axis. In the present invention as in prior art multielement arrays, the beam can be tilted by applying a progressive phase delay to each port 16*a*–16*d*, the phase delay of a given port being the acoustic internal wave phase shift between the port and the internal surface 32 of the transducer element 20.

As used herein in describing the length of the internal wave travel or path in tube 12, the term "effective" defines the actual length of wave travel between a port and surface 32 of element 20 in tube 12, which length can be different than the actual physical spacing between the port and surface 32.

Factors affecting wave phase and amplitude at ports 16*a*–16*d* are the transmission medium in which the waves travel, the effective length of wave travel in tube 12 between a port and surface 32, the size of the port aperture, and the acoustical impedance of any reflecting surface such as an end wall.

In general, the smaller the size of a port aperture, the greater the acoustic wave particle velocity at that port. In one embodiment of the present invention for providing a given symmetrical broadside pattern, ports 16*b* and 16*c* are equal in aperture size and ports 16*a*, 16*d* are equal in aperture size. The aperture size of ports 16*a*, 16*d* is larger than the aperture size for ports 16*b*, 16*c*. Further, the aperture size of each of ports 16*b*, 16*c* is less than the area of surface 30 of element 20, the full area of surface 30 being acoustically exposed to the external transmission medium.

Figure 9:
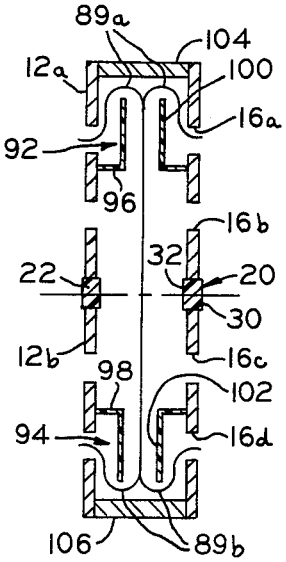
FIG. 9 is a partial and simplified cross sectional view of a phased array transducer similar to the view of FIG. 6 and having phase shift controlling waveguide baffles inserted in the tube for increasing the internal acoustic transmission path lengths.

In general for the transducer arrays of the present invention, the acoustic waves radiated from the outer surface of the transducer element 20 and the surface of the ports 16*a*–16*d* are approximately in phase and the physical spacing between adjacent ports and also between the element 20 and an adjacent port is approximately one-half wavelength of the nominal acoustic operating frequency with variations to provide a desired directional pattern and spurious response attenuation. In one embodiment of the invention such as shown for example in FIG. 9, tube 12 is of aluminum material having a diameter of 4.625 inches and a wall thickness of 0.062 inches. The longitudinal dimension of transducer element 20 is approximately 2.0 inches with its outer surface substantially flush with the inner surface of tube 12. The wall thickness of the element 20 is approximately 3/16 inches. Ports 16*b*, 16*c* are identical in area and symmetrically located about the element 20; likewise the ports 16*a*, 16*d* are identical in area and symmetrically located about element 20. The longitudinal dimension of each of ports 16*b*, 16*c* is 0.75 inches and the longitudinal dimension of each of ports 16*a*, 16*d* is 1.5 inches. The longitudinal spacing between the longitudinal center of element 20 and the longitudinal center of each of the ports 16*b*, 16*c* is approximately 4.525 inches and the longitudinal center to center spacing of ports 16*a*, 16*b* and the longitudinal center to center spacing of ports 16*c*, 16*d* is approximately 4.205 inches. Phase shift control folded wave baffles 92, 94 are used as shown in FIG. 9 to provide approximately zero phase shift of the internal wave between ports 16*a*, 16*b* and zero phase shift between ports 16*c*, 16*d*. The longitudinal spacing between each one of the ports 16*a*, 16*d* and its respective end 104, 106 is approximately 1.67 inches. The ends 104, 106 are of an aluminum material having a thickness of 0.625 inches. The nominal operating frequency of an array having the above dimensions is approximately nine (9) kHz. The longitudinal spacing of the end ports 16*a*, 16*d* from the respective ends 104, 106 is influenced by the acoustical impedance provided by the ends and the resultant standing waves within the tube. In another embodiment, a foam type acoustic material is cemented to the inside surface of the end plates for providing a desired terminating impedance at the tube ends.

The acoustical beam width in the vertical plane is controlled by the number and spacing of ports 16*a*–16*d*, the greater the number of ports the narrower the beam in the vertical direction. The suppression of the relative side lobes is controlled by the velocity or amplitude shading ratios and/or the phase shading ratios, in which the ratio of particle velocity at the active element 20 to the particle velocity at each port is as known in the art for the relative velocities at each active element of prior art multielement arrays. The particle velocity at the apertures 16*a*–16*d* is controlled by the areas of the port apertures as well as the acoustic transmission path between apertures and by the way element 20 generates the acoustic energy inside tube 12.

Element 20 is shown as comprising a single piezoelectric ring 22 having electrodes in four quadrants but it is understood that element 20 could comprise four separate radially polarized piezoelectric quadrant sectors each having an electrode pair or any number of sections and electrode pairs for a desired result.

Tube 12 may be open ended at either or both ends. If the end acoustical wave impedance is substantially matched to the tube wave impedance, there will be a minimum of reflected and standing waves. Baffles 92, 94 in this type of configuration would also be useful in providing a desired phase shift at the ports.

Figure 6:
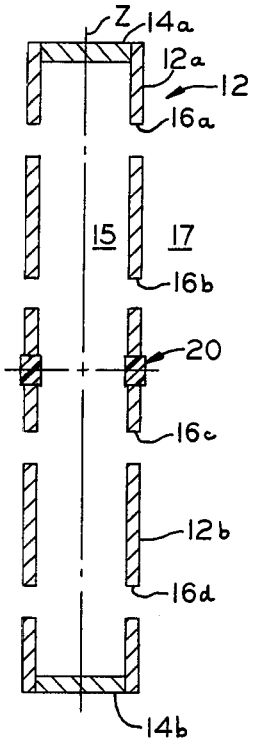
FIG. 6 is a partial and simplified cross sectional view taken along line 6—6 of the phased array transducer of FIG. 2 showing the relationship between the cylindrical transducer element and the annular ports in the wall of the cylindrical tube.
Figure 6A:
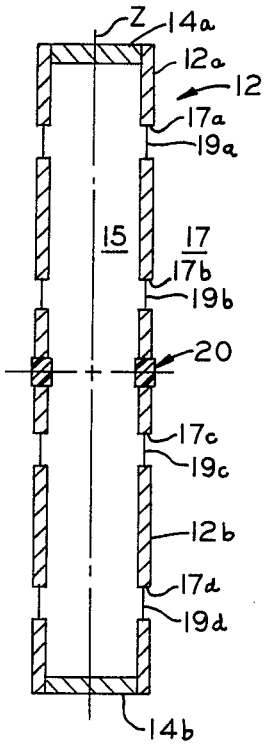
FIG. 6*a* is a view similar to FIG. 6 wherein acoustically transparent membranes cover the annular ports.

Referring to FIG. 6A tube 12 has annular ports 17*a*, 17*b*, 17*c*, 17*d* corresponding to and similar in construction and function to ports 16*a*, 16*b*, 16*c*, 16*d* respectively in the embodiment of FIGS. 1–4. Acoustically transmissive membranes 19*a*, 19*b*, 19*c*, 19*d* are sealed to tube 12 at the edges of ports 17*a*, 17*b*, 17*c*, 17*d* respectively to prevent any flow of internal transmission medium 15 therethrough and seal medium 15 inside tube 12. Medium 15 is selected for its acoustic wave velocity property, which affects the wavelength and phase shift at a given frequency. Medium 15 may be silicone oil or other material having desired acoustic properties. Wavelength varies directly as wave velocity, and for a given port 17*a*–17*d* spacing, varying the relative wave velocity will correspondingly vary the phase shift of the internal wave at the ports.

The phase shift of the internal wave at the ports can also be varied by varying the effective wave path length in tube 12. By providing a folded acoustic internal path the path length is increased without increasing tube 12 length. Also, by using a folded acoustic path, the physical, or actual, longitudinal spacing between each of the ports 16*a*–16*d* and surface 30 of transducer element 20 can be accordingly chosen to provide a desired vertical directivity pattern and reduce side lobes 90, such as shown in FIG. 8, as is known in the art for the relative spacings between active elements of prior art multielement arrays. Reducing side lobes generally increases the acoustic intensity of the broadside main lobe 84 and minimizes spurious signal responses caused by wave reflections from the water surface or sea bed.

One manner of obtaining a folded internal acoustic path between surface 32 of element 20 and selected ports is to use a folded acoustic wave guide baffle internally of tube 12. Referring to FIG. 9, tube 12 is provided with an upper baffle 92, and a lower baffle 94. Baffle 92 is located between ports 16*a*, 16*b* while baffle 94 is located between ports 16*c*, 16*d*. Baffles 92, 94 are of similar construction and have blocking rims 96, 98 respectively affixed to the inner walls of portions 12*a*, 12*b* respectively. Cylindrical tubular chimneys 100, 102 are affixed at their inner ends to rims 96, 98 respectively and are coaxial with tube 12. Chimney 100 extends longitudinally beyond port 16*a* and is directed towards end termination wall 104. Chimney 102 extends beyond port 16*d* and is directed towards end termination wall 106. Thus, direct acoustical communication between surface 32 of element 20 and ports 16*a*, 16*d* or between port pairs 16*a*, 16*b* and 16*c*, 16*d* is blocked by baffles 92, 94 respectively. However acoustical wave communication therebetween is provided by the resulting folded acoustic paths 89*a*, 89*b*. In addition acoustic wave reflection from end walls 104, 106 respectively can also be provided to attain desired phase at the ports 16*a*, 16*d*. Thus the effective wave path length is increased without an increase of the actual physical spacing between the ports and wave phase at ports 16*a*, 16*d* may be adjusted by corresponding placement of ends 104, 106 in tube portions 12*a*, 12*b* respectively and by the actual length of the folded paths 89*a*, 89*b*. Folded path length is of course a function of the longitudinal axial dimension of chimneys 100, 102. Use of baffles 92, 94 provides for a shorter overall tube 12 length and closer physical spacing between the ports 16*a*–16*d* to achieve the desired end or side lobe suppression and vertical directivity. Baffles 92, 94 are not limited to use between the ports shown but may be used between any desired ports to provide the proper acoustic wave phase shift between the ports and/or between any of the ports and surface 32 of the transducer element 20.

Figure 12:
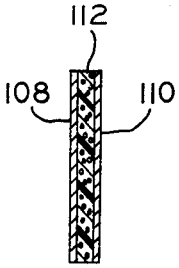
FIG. 12 is an enlarged partial cross sectional view of the baffle shown in FIG. 11 and taken along the line 12—12.

Preferably, baffles 92, 94 are symmetrically longitudinally spaced from element 20, although non-symmetrical spacing may be used to achieve particular phase conditions at particular ports. Baffles 92, 94 are preferably acoustically non-transmissive and may be constructed of a sandwich of two rigid layers such as layers 108, 110, FIG. 12, about an intermediate pressure release layer 112 of an air entrapped material or mesh. For baffles 92, 94 layers 108, 110 may be of brass shim stock and layer 112 may be of a foam plastic. Further, chimneys 100, 102 may be collapsible bellows or telescopic in construction to accommodate a pre-deployment condition of the transducer array 10, later described.

Phase and amplitude may also be adjusted by adjusting the acoustical surface impedance of reflecting surfaces of end walls 104, 106. Referring to FIG. 9, end walls 104, 106 act as reflection surfaces for acoustical wave travel between surface 32 and ports 16*a*, 16*d* respectively. The acoustical properties of end walls 104, 106 affect wave transmission through the end walls 104, 106 and the internal standing wave by the acoustical impedance presented to the cylindrical tube 12 wave which determines the amount of wave reflection and wave absorption or attenuation. The material for end walls 104, 106 is chosen to obtain the desired impedances. Also, end walls 104, 106 while shown longitudinally symmetrically placed from surface 32 may be nonsymmetrically positioned for desired acoustical patterning. It is noted that while tube 12 is shown with end walls 104, 106, a tube with open ends is also usable with the teaching of this invention.

Figure 10:
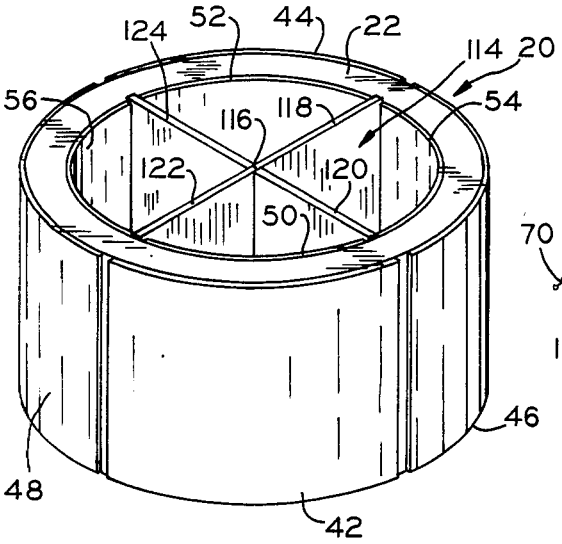
FIG. 10 is an enlarged view in perspective of a cylindrical electroacoustic transducer element in combination with a quadrant electroacoustic transducer element baffle in accordance with the present invention.
Figure 11:
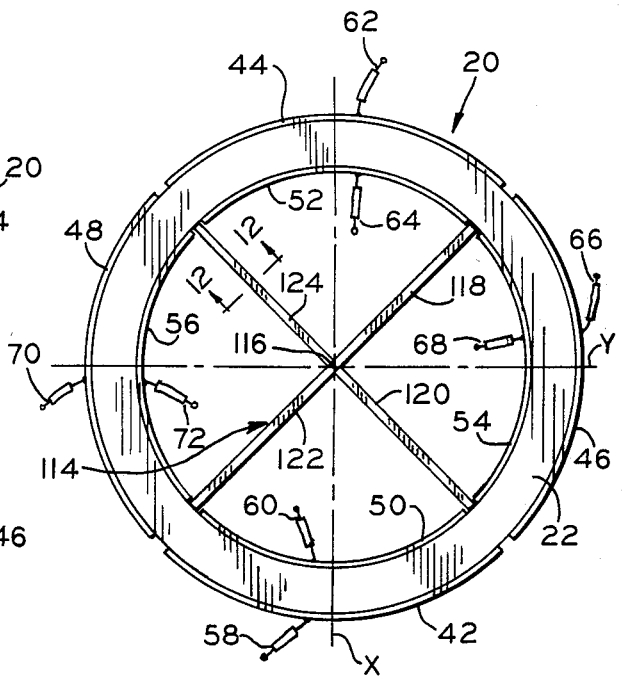
FIG. 11 is a top plan view of the cylindrical electroacoustic transducer element and the element baffle shown in FIG. 10.
Figure 13:
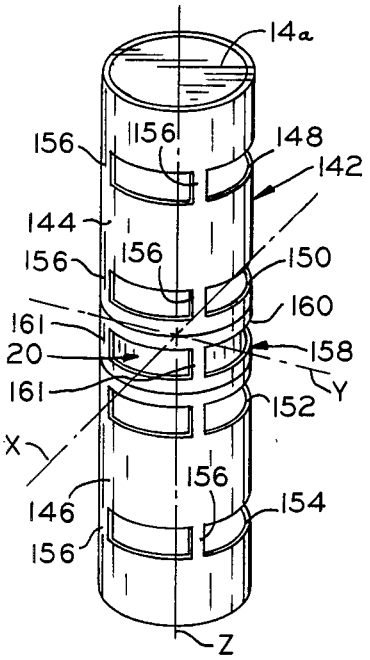
FIG. 13 is a view in perspective of another embodiment of a phased array transducer of the present invention using a different configuration for mounting the cylindrical transducer element.
Figure 14:
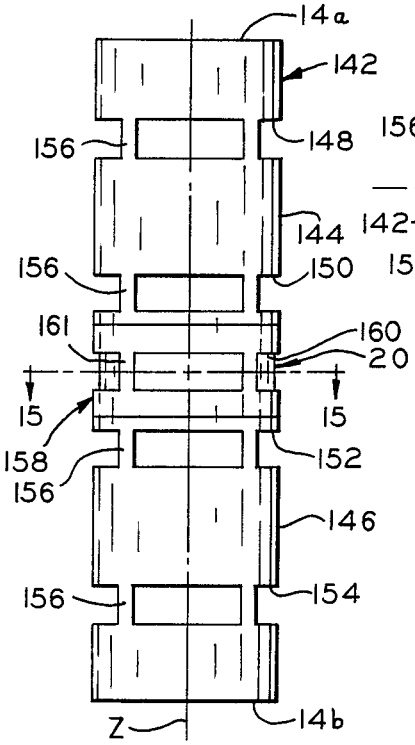
FIG. 14 is a side elevational view of the embodiment of the present invention as shown in FIG. 13.
Figure 14A:
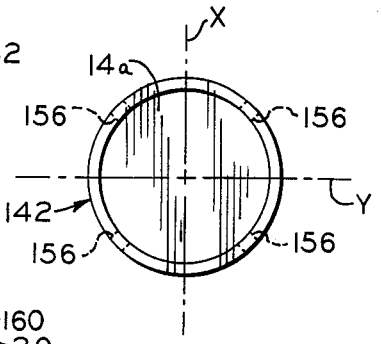
FIG. 14A is a top plan view of the embodiment shown in FIGS. 13 and 14.
Figure 15:
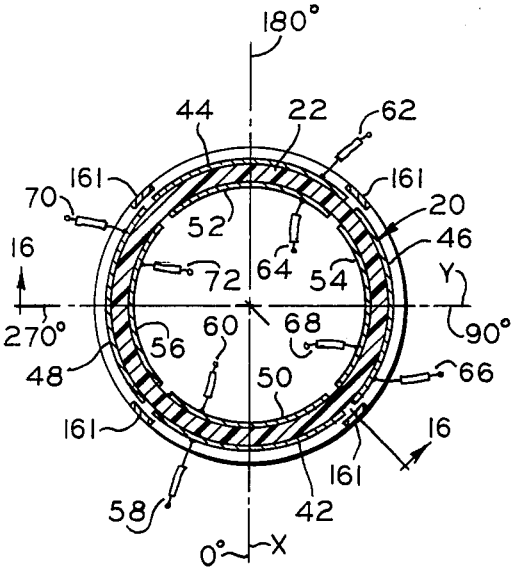
FIG. 15 is an enlarged partial cross sectional view taken along line 15—15 in FIG. 14.
Figure 16:
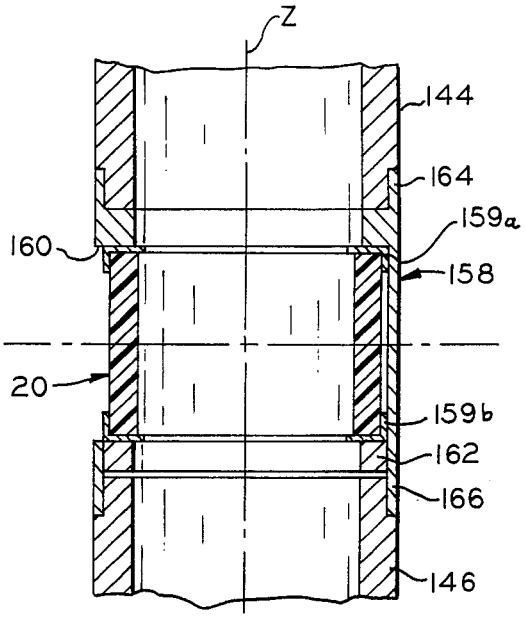
FIG. 16 is an enlarged partial sectional view of the electroacoustic transducer element portion of the phased array taken along line 16—16 in FIG. 15.

This invention also provides a baffle construction for improving the coupling between the transducer element 20 and the internal transmission medium. Referring to FIGS. 10 and 11, cavity baffle 114 is mounted in the cavity or central space defined by the inner walls of transducer element 20. Cavity baffle 114 has center axis 116 and radially extending partitions 118, 120, 122, 124 all of which extend toward but are separated from direct contact with the inner wall 32 of ring 22. The respective ends of the extending partitions may be affixed to the inner wall using a resilient material such as for example a polyurethane. It is desired that the ends of the partitions be acoustically isolated from the ring to prevent transmission of acoustic vibrations between the ring and the extending partitions. Other materials, methods and structures of affixing the cavity baffle 114 to the inside of transducer element 20 may be used. Partition 118 is between electrodes 52, 54; partition 120 is between electrodes 54, 50; partition 122 is between electrodes 50, 56; and partition 124 is between electrodes 56, 52. In general, where sine and cosine like horizontal field patterns are desired, the number of partitions is equal to the number of electrode pairs such as is shown in FIG. 10. Likewise a cavity baffle can be used with other configurations of the transducer element 20, such as for example element 280 shown in FIG. 21.

In any case of the transducer element 20 providing horizontal directional patterns such as shown in FIG. 7, the diametral partitions would lie along or be positioned on diametral lines intermediate the X, Y axes. In a transducer array in accordance with this invention having a transducer element for providing a single sine or cosine like pattern, such as for example the cosine pattern 76 of FIG. 7, a single partition can be used extending diametrically along the Y axis. Likewise, for the sine pattern response 78, the partition would lie along the X axis. In general, the partition or partitions of the baffle are positioned to lie along axes which intersect the theoretical and major minimum response points of the directional pattern or patterns. The partitions are coextensive longitudinally axially of element 20 to prevent direct transverse or chordal acoustical communication between one partitioned portion and another in the longitudinal or axial confines of element 20. The ends of baffle 114 are open to provide substantially unobstructed acoustic wave travel longitudinally of tube 12.

Cavity baffle 114 increases the effective pressure gradient to ceramic ring 22 of element 20 when the acoustic signal pressure of the ring cavity or central opening is utilized in the actuation of the ring, as it would be in the receiving mode. Baffle 114 also raises the resonant frequency of the cavity within ring 22 of element 20. Baffle 114 improves acoustic sine like and cosine like wave directivity in the horizontal plane. The partitions of baffle 114 have a low acoustic transmission and are of a construction as described and shown in FIG. 12; layers 108, 110 may be of aluminum and layer 112 may be of an air containment screen mesh.

A more accurate determination of the acoustic path length involves the solution of the equations known in the art and treated for example in the previously cited text references for the acoustic wave in the tube with various boundary conditions. These boundary conditions include velocity of the inside wall 32 of the element 20, dimensions of the element 20 cavity, acoustic impedance of tube 12 at the interface of the element 20 cavity, and the acoustic impedance of tube 12 at each longitudinal port location which impedance is in turn a function of the radiation impedance of the port and the acoustic impedance of the tube extending beyond the port. In general, matching the impedance of element 20 to tube portions 12*a*, 12*b* will result in more efficient transfer of the acoustic wave energy. Boundary conditions will vary depending on the manner in which element 20 is mounted to tube 12. Also, adverse vibration transfer between tube 12 and element 20 degrade wave pattern directivity. Mounting of tube 12 to element 20 should isolate vibrations from one another and prevent cross coupling of mechanical vibrations.

Referring now to FIGS. 13–16, elongated tube 142 has upper elongated portion 144 and lower elongated portion 146. Annular ports 148, 150 are formed in portion 144 and annular ports 152, 154 are formed in portion 146. Arcuately spaced longitudinal ribs 156 are positioned in ports 148–154 for tube support. Portions 144, 146 correspond to portions 12*a*, 12*b*, respectively; ports 148, 150, 152, 154 correspond to ports 16*a*, 16*b*, 16*c*, 16*d*, respectively; and ribs 156 correspond to ribs 18. Corresponding members are similar in construction and function.

A hollow cylindrical collar 158 has annular port 160 with arcuately spaced longitudinal ribs 161 formed therein. Transducer element 20, previously described, is positioned within the pocket formed inside collar 158 and is secured therein by retaining ring 162 inserted in the lower end of collar 158. Upper and lower ring gaskets 159*a*, 159*b* respectively are of a suitable material such as Corprene TM or rubber to provide acoustic isolation of the element 20 from collar 158 and retaining ring 162. Collar 158, ring 162 may be of any suitable material such as metal or plastic. Transducer element 20 is of course protected from its operating environment by a protective coating or encapsulation not shown. Collar 158 has upper annular flange 164 and lower annular flange 166 extending from the upper and lower ends, respectively thereof. Tube portion 144 seats securely inside flange 164 and portion 146 seats securely inside flange 166. Attachment of the retaining ring 162 to collar 158 and the collar 158 to the upper and lower portions of tube 142 may be by any suitable fastening means such as an adhesive, machine screws, or rivets, not shown.

The embodiment in FIGS. 13–16 operates in a manner similar to that for the embodiment of FIGS. 1–6. Baffles 92, 94 and 114 may also be utilized for their purposes and advantages in the embodiment of FIGS. 13–16. End walls 104, 106 may be placed in portions 144, 146 in a manner to obtain the desired wave amplitude and phase shift adjustment for the internal wave, as previously described.

Referring to FIGS. 17–20A, an embodiment is shown in both pre-deployed and deployed states. Transducer array 172 corresponds to array 10 in the embodiment of FIGS. 1–6 and in the FIG. 17 cross section the ports are not shown. Transducer tube 176 is telescoped over electronics canister 170 in a pre-deployed state, FIG. 17, prior to use to conserve space and provide transducer protection in packaging, shipment, and storage and then the transducer to the deployed state, FIGS. 18, 19, when in use.

Elongated cylindrical canister 170 houses the electronics package which is coupled to leads 58–72, not shown in FIGS. 17–20A, of element 20 via cable 194 to receive electrical signals from and/or transmit electrical signals to element 20 depending on whether transducer array 172 is in a receiving or transmitting mode, respectively. Signal cable 174 extends from the upper end of canister 170 to transmit and/or receive electrical signals to a surface floated electronic canister, not shown, which normally contains an radio frequency transmitter or transceiver and associated antenna. Cable 174 can also comprise a suspension cable for suspending the deployed transducer array 172 in the water. Element 20 has baffle 114 inserted therein in a manner and for purposes as previously described.

Electronics canister 170 has annular guide flanges 184, 188 extending outwardly from the canister 170 spaced from the upper and at the lower ends of the canister respectively. Annular flange 188 is slidable along the inner wall of tube 176 during transition between the pre-deployed and deployed states. Tube 176 has an inner annular flange 178 at its upper end and is slidable along the outer wall of canister 170 during transition between the pre-deployed and deployed states. The coaction of flange 178 with flanges 184, 188 limit relative longitudinal travel of canister 170 within tube 176. In the pre-deployed state, flange 184 seats against flange 178 and limits further travel of canister 170 into tube 176 and provides space between the bottom of tube 176 and bottom end of canister 170 for storage of transducer 20, signal cable 194, and transducer element 20 suspension cables 196. In the deployed state flange 188 seats against flange 178 and limits any further withdrawal of canister 170 from tube 176. Cylindrical tube 176 has an end termination wall 180 at its lower end. Acoustic wave impedance disk 182 is affixed to and coextensive with inner side of wall 180. Lower end 190 of canister 170 is provided on its lower surface with an acoustic wave impedance disk 192. In the deployed state, the impedance of the combination of end 180 and disk 182 and the combination of end 190 and disk 192 function similar to ends 106 and 104 respectively as previously described and shown in FIG. 9. Disks 182, 192 provide impedance terminations of the ported tube 176 of the transducer array 172.

Electrode leads 58–72 are connected to canister 170 in flexible cable 194. Element 20 is suspended from canister 170 end wall 190 by a plurality of flexible cords 196, the lower ends of which are molded in encapsulating material 24 or otherwise attached to element 20. The upper ends of cords 196 are secured to wall 190 by suitable means. Cable 194 and cords 196 are collapsed in the pre-deployed state. Cords 196 are extended to their full length in the deployed state, and are of a length to position element 20 opposite annular port 198 formed in tube 176. Longitudinally spaced annular ports 200, 202, 204, 206, which correspond to ports **16*a*, 16*b*, 16*c*, 16*d*, respectively, are formed in tube 176, each port having longitudinal supporting ribs 208, which correspond to ribs 18**, formed therein. Corresponding parts are similar in construction and function. It should be understood that the transducer array of the present invention need not be attached to or suspended from an electronics canister such as is shown herein but may if desired be otherwise suspended from available and appropriate types of surface or sub-surface members.

Figure 20:
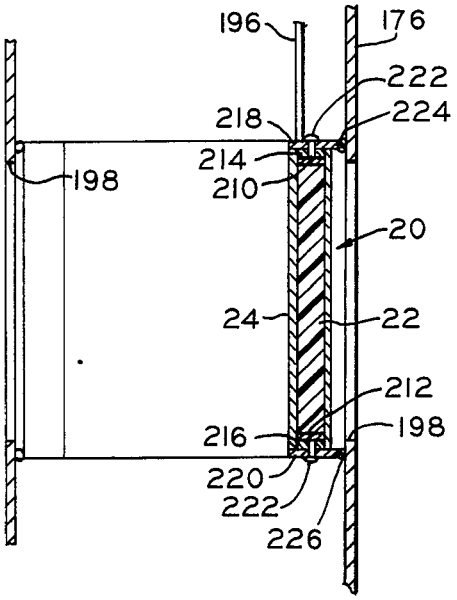
FIG. 20 is an enlarged partially sectioned partial view of the electroacoustic transducer element portion of the embodiment disclosed in FIGS. 17–19.
Figure 20A:
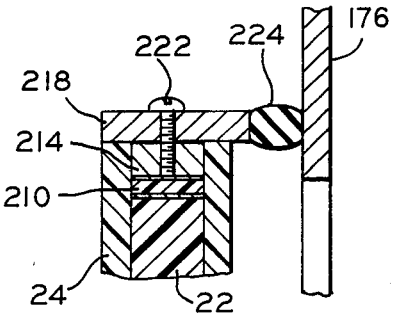
FIG. 20A is a further enlarged sectioned partial view of the element and tube of the embodiment of FIGS. 17–20 in the deployed state.

Referring to FIGS. 20, 20A, annular end shields 210, 212 are of a pressure release material such as an air entrapped material or mesh and are placed over and under the upper and lower ends respectively of ring 22, and function to reduce acoustic radiation from the ends of ring 22 into tube 176.

Flat support annuli 214, 216 are placed above and below, respectively, shields 210, 212 and retaining annuli 218, 220 are secured as by bolts 222 to support annuli 214, 216 respectively. The outer perimeters of retaining annuli 218, 220 extend radially beyond the outer wall of material 24 and abut resilient, acoustic isolator rings 224, 226, respectively. Rings 224, 226 are affixed as by cementing such as with epoxy to the annuli 218, 220, respectively, and may be of Corprene TM material, rubber, or other resilient material and act as acoustic seals to prevent an acoustic leakage path between the outer surface of element 20 and the interior of tube 176. Rings 224, 226 may also comprise suitable "O" rings fitted in annular grooves (not shown) in the retaining annuli 218, 220.

Figure 17:
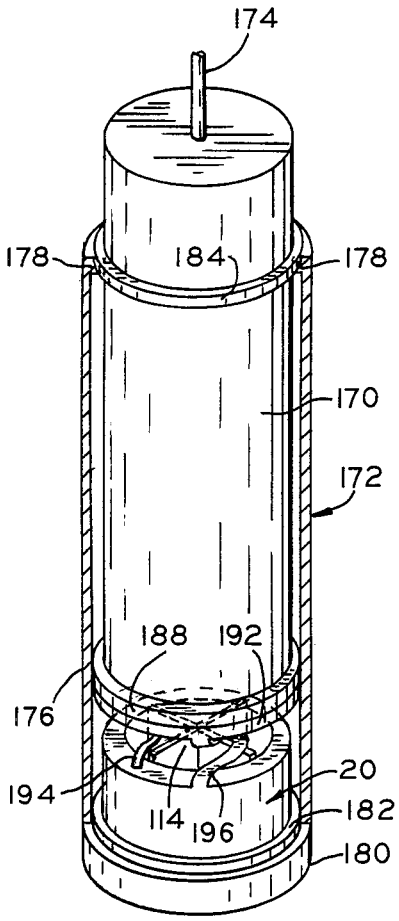
FIG. 17 is a view in perspective of the phased array transducer suitable for use in a sonobuoy and showing the transducer prior to its deployment.
Figure 18:
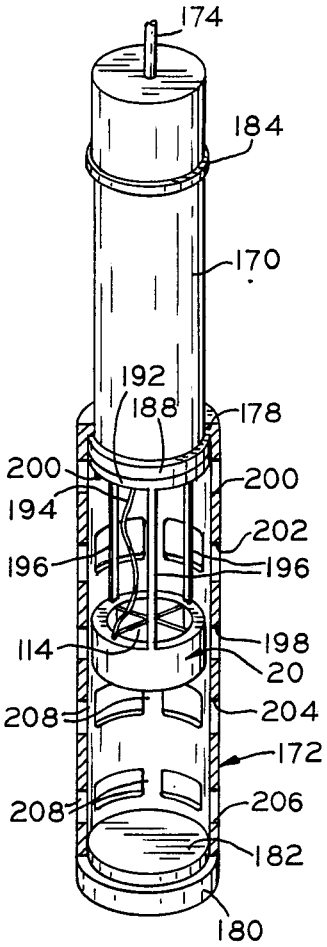
FIG. 18 is a view in perspective of the embodiment of FIG. 17 shown after deployment.
Figure 19:
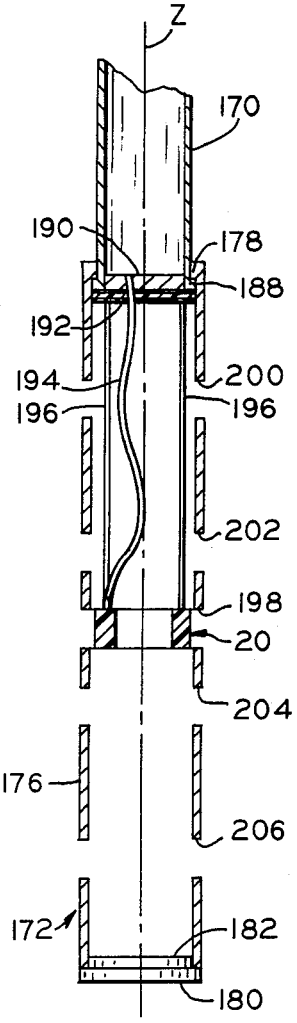
FIG. 19 is a partial and simplified longitudinal cross sectional view of the deployed phased array transducer shown in FIG. 18 showing the relationship of the cylindrical transducer element and the annular ports in the wall of the cylindrical tube.

In the operation of the embodiment of FIGS. 17–20, transducer array 172 is deployed from the pre-deployment state of FIG. 17 by the sliding of tube 176 downwardly on canister 170 until flanges 178, 188 seat. Element 20 slides within tube 176 until cords 196 are taut, at which time element 20 is opposite port 198. The electroacoustic transducer operation is as described for previous embodiments. Baffles 92, 94, not shown in FIGS. 17–20, may be positioned in tube 176 above and below element 20, respectively and are preferably of the kind that have collapsible or telescopic chimneys 100, 102 so that in the pre-deployed state the profile of canister 170 and transducer 172 has a minimum longitudinal dimension and upon deployment, the chimneys 100, 102 extend to their full longitudinal dimension. The deployment may be manually or automatically accomplished as is known in the art. Baffles 92, 94 are preferably suspended by flexible cords similar to cords 196 and be of a length to position baffles 92, 94 in their proper relation to ports 200–206 to obtain the desired length of wave travel in tube 176. Suitable baffle plates such as plates 304, 306, 308 as hereinafter described in relation to FIGS. 23–25 may also be used in lieu of chimney baffles 92, 94 and can likewise be suspended by flexible cords similar to cords 196 of suitable lengths to position the plates in proper locational relationship to the ports 200–206 for providing desired length of internal wave travel between the ports and thus provide proper internal phase shift.

Figure 21:
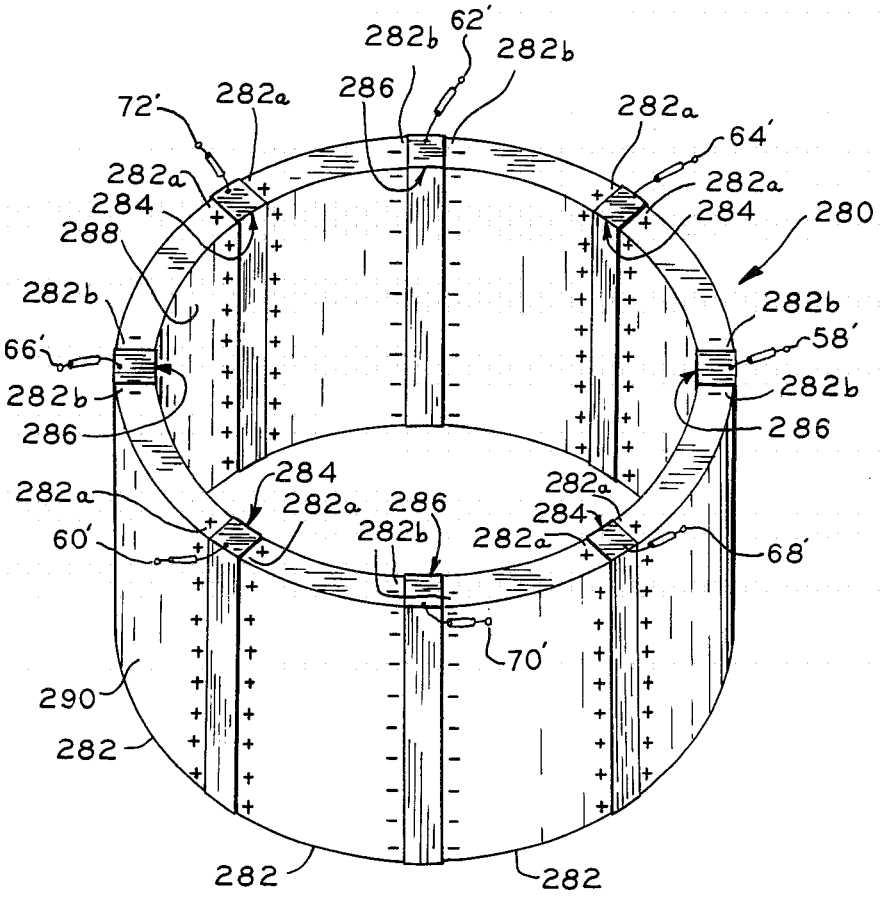
FIG. 21 is a view in perspective of a further electroacoustic transducer element that is a circular cylinder that is polarized tangentially and is usable in the phased arrays of this invention.

Referring to FIG. 21, a further electroacoustic transducer element 280 is shown. Element 280 may be used in place of element 20 in previously described embodiments of this invention. Element 280 is a cylindrical ring composed of arcuate segments 282 of electroacoustic or piezoelectric material, such as that previously described for ring 22. Each segment 282 is polarized in a tangential direction so that one circumferential edge **282*a* is a positive pole and the opposite circumferential edge 282*b* is negative so that expansion and contractions in a circumferential direction reciprocally convert to electrical signals. Segments 282 are electrically coupled and adhered at their opposite circumferentially spaced vertical edges 282***a*, 282*b* to a thin conductive electrode 284, 286 respectively. Each electrode 284 is coupled to the positive pole edges 282*a* of two adjacent segments 282 and each electrode 286 is coupled to the negative pole edges 282*b* of two adjacent segments 282. Although the transducer element 280 as shown in FIG. 21 is interchangeable with and can provide the same type sine and cosine like and omnidirectional patterns as the previously described element 20, the configuration shown in FIG. 21 can be made capable of operating at greater acoustic power levels and in such instance may be preferred when the transducer array is to be used for transmitting acoustic signals. An example of the latter would be the use of the transducer array in an active type sonobuoy system where an acoustic signal is first transmitted and radiated in an omnidirectional pattern after which the sonobuoy is switched to a receive mode using the horizontal directional properties of the array to determine the relative direction of any resultant acoustic energy reflected and received from distant objects.

Connection of electrodes 284, 286 may be made to obtain the omnidirectional, sine, cosine, or other desired patterns. Connecting electodes 284 to a first common lead and electrodes 286 to a second common lead will provide an omnidirectional pattern. Connecting the leads from electrodes in opposite quadrants as previously described will produce sine and cosine patterns. Element 280 could be mounted in the ported tubes of the previous embodiments in the manner of mounting element 20, the interior surface 288 communicating with the internal medium in the tube and the external surface 290 of element 280 communicating with the external transmission medium.

Figure 22:
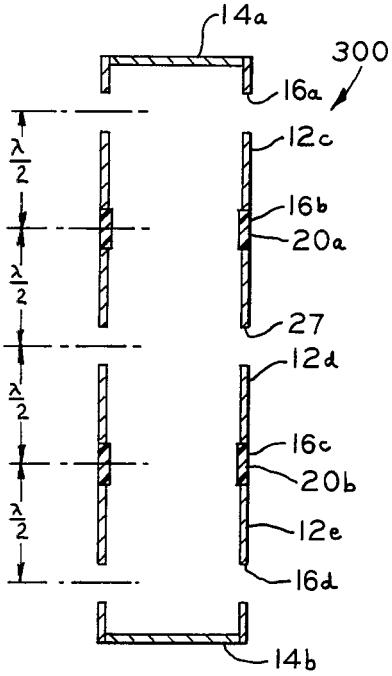
FIG. 22 is a simplified longitudinal cross section of an arrray of this invention having alternate ports and transducer elements.

Referring to FIG. 22, a phased transducer array 300 is shown in longitudinal section and is similar to array 10 shown in FIGS. 1–4 except that tube 12 has three sections 12*c*, 12*d*, 12*e* and two electroacoustic elements 20*a*, 20*b* are mounted therein. Element 20*a* is mounted between sections 12*c*, 12*d* (in port 16*b*) and element 20*b* is mounted between sections 12*d*, 12*e* (in port 16*c*). Each element 20*a*, 20*b* may be of the same cylindrical construction as previously described and such as for example shown in FIG. 10 and may be mounted between their respective tube sections in similar manner to element 20 construction and manner of mounting between tube sections 12*a*, 12*b* in array 10. Port 27 is formed in section 12*d* in the manner that ports 16*a*–16*d* are formed in their respective tube sections in array 10 with ribs 18 being configured and positioned as described for ports 16*a*–16*d*. Ports 16*a*–16*d* in arrays 10 (FIG. 1), 300 (FIG. 22) are similar. Ports 16*a*, 27, 16*d* in array 300 effectively act as active transducer elements and the longitudinal or axial physical spacing between port 16*a* and element 20*a* in port 16*b* is approximately one half wavelength of a nominal wave in the frequency band of operation for array 300. Similarly, port 16*d* is physically spaced longitudinally one half wavelength below element 20*b* and port 27 is physically spaced longitudinally between elements 20*a*, 20*b* and approximately one half wavelength from each of them. In this embodiment internal phase shift control members are not necessary to obtain the desired reinforcing at ports 16*a*, 27, 16*d* since the ports are each already at the desired spacing for reinforcement and wave pattern shaping. Further, elements 20*a*, 20*b* are at a one wavelength spacing from one another and therefore are mutually reinforcing at port 27. Additional ports and elements may be added at one half wavelength longitudinal spacing in port-element alternating relation.

Figure 23A:
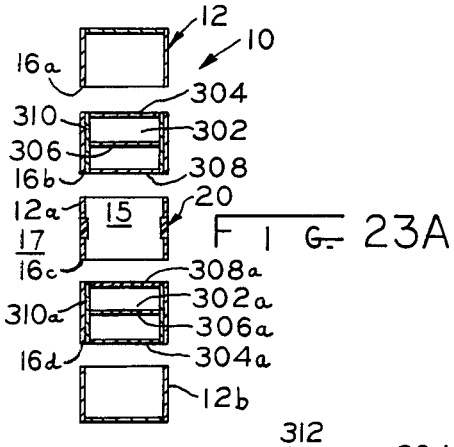
FIG. 23A is simplified longitudinal cross section of a transducer array having two phase shift controls of the kind shown in FIG. 23 mounted in an array tube.
Figure 23:
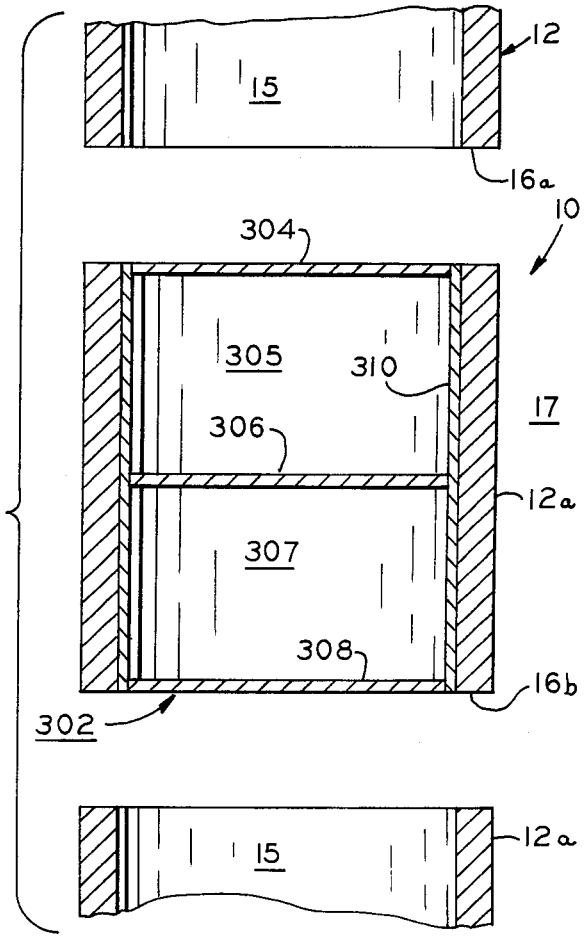
FIG. 23 is a partial enlarged, simplified, longitudinal cross section of an array of this invention having another embodiment of a phase shift control internally of the array tube comprising a plurality of circular perforated plates.
Figure 24:
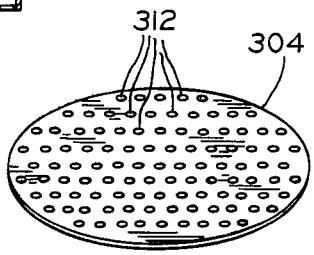
FIG. 24 is a view in perspective of a single perforated plate of the FIG. 23 embodiment.
Figure 25:
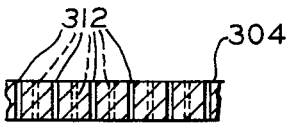
FIG. 25 is an enlarged cross section of a portion of the plate in FIG. 24.

Referring to FIGS. 23–25 another internal phase shift control member 302 is shown and described in connection with array 10 shown in FIGS. 1–3. Mounted in tube section 12*a* of array 10, shown in partial section in FIG. 23, member 302 comprises three circular perforated longitudinally spaced baffles or plates 304, 306, 308 shown positioned between ports 16*a*, 16*b*. Plates 304, 306, 308 are similar in construction to one another and are fixedly spaced longitudinally in tubular cylinder 310 the outer surface of which is affixed as by cementing to the inner wall of section 12*a*. Plates 304, 306, 308 are each longitudinally spaced from the next adjacent plate by approximately one eighth wavelength of a nominal frequency in the frequency band for which array 10 is designed. Plates 304, 306, 308 are cemented as with epoxy cement or otherwise firmly affixed at their peripheries to the inner wall of cylinder 310. Alternatively, plates 304, 306, 308 could be firmly affixed at their respective peripheral edges to the inner wall surface of tube section 12*a* as with epoxy cement. It is important that mounting of plates 304, 306, 308 be such as to minimize plate vibration. Other manners of affixing plates 304, 306, 308 in place may be utilized. It is understood a phase shift control member similar to member 302 is mounted in similar manner between ports 16*c*, 16*d* of tube section 12*b* as shown in FIG. 23A. In one embodiment of the phase control member 302, the baffle plates 304, 306 and 308 were made from perforated aluminum having a hole size of 0.062 inches and an open to closed ratio of approximately 40% at a nominal operating frequency of nine (9) kHz.

Referring to FIG. 23A, an embodiment is shown wherein an array 10, similar to that shown in FIGS. 1–5, has a phase shift control member 302 mounted between ports 16*a*, 16*b*, and phase shift control member 302*a* mounted between ports 16*c*, 16*d*. Member 302*a* has plates 304*a*, 306*a*, 308*a* mounted in cylinder 310*a* and are similar in construction and operation to member 302, plates 304, 306, 308, and cylinder 310, respectively.

Referring to FIGS. 24, 25 plate 304 will be described. The longitudinal spacing of the plates may vary depending on the hole 312 diameter, the number of plates, the number of holes on each of plates 304, 306, 308, the hole total area on each plate, but the longitudinal plate spacing is preferably not greater than one eighth wavelength of the aforementioned nominal frequency.

Member 302 functions to maintain a minimal or substantially reduced phase shift of an acoustical wave between its longitudinal ends. A lesser or greater number of plates 304, 306, 308 may be used in member 302.

Phase shift control member 302 controls the phase between ports 16*a*, 16*b* of transducer tube 12. In particular, member 302 produces a low or minimum phase shift in the acoustic wave as the wave propagates along the axis of tube 12. The phase is thus controlled locally, as by member 302, along the length of the acoustically distributed—parameter tube 12, which can be considered to be an acoustical transmission line. Without a phase control member for local phase shift control, the acoustical wave would be controlled by the distributed nature of the tube and a phase shift would occur along a short length of the tube. The phase is controlled as by member 302 along the length of the tube between pertinent adjacent ports to satisfy the relative phase required of the waves which radiate from these adjacent ports.

The relative phase is determined from requirements to obtain the desired vertical directivity pattern.

In member 302, spaced plates 304, 306, 308 each have holes 312 and are used to form a low pass acoustic filter having a cut off frequency. When the frequency of the internal wave in the transducer tube 12 is substantially below the cutoff frequency of the low pass filter, only a small or minimum phase shift of the acoustical wave which passes through member 302 occurs and the wave is attenuated only a small or minimum amount. As will be understood by those in the art, a zero degree (0°) phase shift is equivalent to a 360° phase shift. To the extent that member 302 does not shift the phase of the acoustical wave a full 360° an additional phase shift may be added to the wave to attain the 360° shift with other means such as additional transmission path length.

Each plate 304, 306, 308 of filter 302 is mounted transversely to the axis of the transducer tube 12. The holes 312 in each plate 304, 306, 308 become acoustical masses which are in parallel with each other in an equivalent circuit configuration. Chamber 305 created between adjacent plates 304, 306, and chamber 307 created between adjacent plates 306, 308 each forms an acoustical compliance or stiffness.

The overall acoustical mass created by the holes 312 in each plate 304, 306, 308 acts in series with the acoustical wave traveling along the axis of the tube 12. The compliant chambers 305, 307 between adjacent plates each forms a compliant reactance to "acoustical ground". The final plate in the direction of wave propagation is terminated by the acoustical impedance of the remaining length of the tube 12. An equivalent acoustical circuit is a ladder network that has the acoustical masses and compliant chambers as circuit elements which define a cutoff frequency for the low pass filter structure.

The filter may be designed so that the cutoff frequency is sufficiently above the operating acoustical wave frequency of the transducer 10. The low phase shift across filter 302 results because of this property of the low pass filter below cutoff and because the acoustical energies in the masses and compliances act like lumped circuit elements. Thus the energy in the acoustical wave is passed along the structure with low phase shift.

The spacing between adjacent plates 304, 306, 308 and therefore the dimensions of the compliant cavities 305, 307 is designed to be substantially less than a wavelength of a nominal operating frequency of sound in the internal transmission medium 15 in tube 12, and is typically an eighth-wavelength or less, so that each compliant chamber 305, 307 can be considered to be a lumped element. Also, the holes 312 in the perforated metal plates 304, 306, 308 are designed to have the correct acoustical mass to provide the desired cutoff frequency, yet not be too small to have an appreciable acoustical resistance. In other words, the mass reactance of the holes 312 should predominate over the resistive component of the impedance of the plates 304, 306, 308.

The number of plates 304, 306, 308 required depends upon the length of the tube 12 over which a minimal amount of phase shift is desired for the internal acoustical wave. For example, a longer section of tube 12 in which phase shift control is desired, requires more plates 304, 306, 308 to satisfy the eighth-wavelength, or less, criterion to preserve the lumped element consideration for the compliant chambers 305, 307. As the number of plates changes, the size of the holes 312 in each plate changes to maintain the same cutoff frequency relative to the operating frequency of the transducer 10.

The low pass filter 302 is a useful structure for the tube 12 (acoustical transmission line) to control phase of the internal wave at a particular location along an otherwise distributed parameter acoustical "transmission line" tube 12.

The filter structure 302 also provides some isolation between sections of the tube 12 to avoid any adverse internal interactions of adjacent ports **16*a*–16*d*. The filter 302** is easily packaged by collapsing its structure and is easily deployed in an inverse mechanical manner. For a discussion of filter theory cf. "Electromechanical Transducers and Wave Filters" by Warren P. Mason, Second Edition, D. Van Nostrand Co. Inc., Princeton N. J.

Factors affecting the performance of array 10 include the number, spacing, and symmetry of the ports **16*a*–16*d*, the relative acoustical properties of the internal medium 15 and the external medium 17, the width of struts 18 in the circumferential direction, the end terminations of tube 12; the number, placement and dimensions of baffles 92, 94; and the number, spacing, hole size, and total hole area of the plates in baffle member 302**.

Modifications that can be employed with the teaching of this invention include variations in placement and orientation of ribs in their respective port apertures; the number and placement of ports **16*a*–16*d* and number and placement of elements 20; the type and placement of phase shift control baffles 92, 94, 302; the manner of mounting element 20 and baffles 92, 94, 114, 302 to their respective tube or element walls; the number, configuration, placement, and manner of mounting the electrodes on ring 22; materials for tube 12, ends 14*a*, 14*b* and baffles 92, 94, 114, 302; the properties of internal medium 15, and in the manner of processing the electrical signals to and from element 20 to obtain the desired pattern in the horizontal plane. Also, instead of making ring 22 entirely of a piezoelectric material, this invention embraces the use of a cylinder of metal, plastic or other relatively inexpensive support material to which are affixed arcuate sections of piezoelectric transducer material at those areas on the inside and/or outside surfaces of such cylinder that obtain the desired patterns and responses. In this manner, a relatively low cost transducer 20** is provided.

Numerous other changes, modifications, and adaptations of the disclosed invention can be made by those having ordinary skill in the art without departing from the spirit of the invention. It is intended that such changes, modifications, and adaptations of the invention will be within the scope of the following appended claims.

I claim:

1. A cylindrical passed array transducer for transmitting or receiving acoustic waves in a liquid external transmission medium, comprising:

a first electroacoustic transducer element means having at least first and second vibratile surfaces for radiating and responding to acoustic waves in transmission mediums coupled respectively thereto;

an elongated cylindrical tube having a longitudinal axis and having first and second axial ends and a cylindrical wall;

acoustic coupling means including at least a first pair of first and second port means being formed in said wall, each of said first and second port means for providing one or more openings in a substantially arcuate configuration on a periphery of said tube wall;

said tube for being filled internally with an acoustic transmission internal medium for providing an interior acoustic transmission path between said second vibratile surface and each of said first and second port means; said first and second port means each providing acoustic coupling between the liquid external transmission medium and the transmission internal medium;

said tube being of a material having a different acoustic characteristic impedance to acoustic waves than the liquid transmission external medium to provide an acoustic transmission path boundary for acoustic waves traveling interiorly of said tube between said transducer element means and said port means; said openings in said port means having an acoustic characteristic impedance so that there is provided substantially unattenuated transmission of acoustic waves through said openings;

first means for supporting said transducer element means relative said cylindrical tube at a position axially between and axially spaced from each of said first and second port means, and so that said first vibratile surface of said transducer element means is acoustically coupled with the liquid external medium and said second vibratile surface is acoustically coupled to said internal medium; said transmission paths being characterized in that within a frequency band of transducer operation, the effective acoustic length of said paths provides a reinforcing combination of acoustic radiation from said first vibratile surface and said port means in the liquid transmission external medium, said radiation having a direction broadside said longitudinal axis whereby maximum radiation of acoustic waves in the transmission external medium or maximum response to acoustic waves in the liquid transmission external medium occurs in said direction.

2. The apparatus of claim 1 wherein said arcuate configuration is an annular configuration.

3. The apparatus of claim 1 including a second electroacoustic transducer element means, said first and second element means each having first and second vibratile surfaces and each element means being supported in said tube so that said first surfaces are acoustically coupled to said external transmission medium and said second surfaces are acoustically coupled to said internal medium;

said coupling means including a third port means being in said tube so that said second port means is between said first and third port means;

said first means for axially positioning and supporting said first element means relative said tube at an axial position between said first and second port means;

second means for supporting and axially positioning said second elements means relative said tube between said second and third port means to provide an interior acoustic transmission path between said second element means second surface and each of said second and third port means.

4. The apparatus of claim 2 wherein said transducer element is for controlling the acoustical wave radiation or response pattern to acoustical waves in a plane substantially perpendicular to said axis and said port means are for aiding in controlling the acoustical pattern or response in a plane of said axis.

5. The apparatus of claim 3 wherein each said transducer element means is for controlling the acoustical wave pattern or response to acoustical waves in a plane substantially perpendicular to said axis and said port means are for aiding in controlling the acoustical pattern or response in a plane of said axis.

6. The apparatus of claims 4 or 5 wherein each said transducer element means is for generating a sine like and/or cosine like broadside pattern and said port means are for providing a control factor in determining the dimension of said broadside pattern parallel to said axis.

7. The apparatus of claim 6 wherein each said transducer element means comprises a piezoelectric ring having inner and outer surfaces; said first vibratile surface comprising said ring outer surface and said second vibratile surface comprising said ring inner surface; said ring having four circumferential quadrants; said ring having an electrode pair in each of said four quadrants; one electrode in each pair being conductively affixed to said ring outer surface and the other electrode in each pair being conductively affixed to said ring inner surface.

8. The apparatus of claim 2 wherein each of said port means is spaced from said transducer element means second vibratile surface a distance to provide a travel in each of said interior paths of approximately one half wavelength of a predetermined frequency.

9. The apparatus of claim 4 wherein said coupling means includes a second pair of annular port means; a first port means in said second pair of port means being axially spaced in a first axial direction from said first port means in said first pair of port means and a second port means in said second pair of port means being axially spaced in a second axial direction opposite to said first axial direction from said second port means in said first pair of port means.

10. The apparatus of claim 9 wherein said port means are axially symmetrically spaced from a predetermined point on said tube.

11. The apparatus of claim 9 wherein the sum of the areas of said openings in each of said port means in said first pair of port means comprises a first port aperture; the sum of the areas of said openings in each of said port means in said second pair of port means comprises a second port aperture; said first port aperture being smaller in area than said second port aperture; said first port aperture being smaller in area than the area of said first vibratile surface.

12. The apparatus of claim 9 wherein the port means of said first and second pair of port means are spaced symmetrically on said tube from said transducer element means.

13. The apparatus of claims 1 or 3 wherein each said transducer element means comprises an electroacoustic transducer ring having inner and outer surfaces, said inner surface defining a ring cavity; said first vibratile surface comprising said ring outer surface and said second vibratile surface comprising said ring inner surface;

cavity baffle means being placed in said ring cavity for improving the wave pressure gradient to said inner surface of said ring of said transducer element means.

14. The apparatus of claims 2, 3, 4, 5, or 9 including phase shift means for shifting the phase at at least one of said port means of acoustical waves in a respective said interior path to vary said acoustical wave beam pattern and response to acoustic waves.

15. The apparatus of claim 14 wherein said phase shift means comprises a folded wave baffle means inserted in said respective interior path for folding the acoustical wave path between said second surface and said at least one port means to increase the path length of said respective interior path in said internal medium a predetermined amount whereby the acoustical wave phase is correspondingly shifted at said at least one port means.

16. The apparatus of claim 15 wherein said first and second axial ends of said tube are closed and said phase shift means comprises a reflecting surface on at least one of said closed ends; said baffle means for causing acoustical waves in said interior passage to be reflected from said reflecting surface.

17. The apparatus of claim 3 wherein each of said port means is spaced from the nearer said transducer element means second vibratile surface a distance to provide a travel in each of said interior paths of approximately one half wavelength of a predetermined frequency in the operational frequency band of the transducer.

18. The apparatus of claim 12 wherein said port means in said first pair of port means are axially spaced from said transducer element means second surface to provide an acoustical travel length along said path between each of said port means in said first pair of port means and said second surface of approximately one half wavelength of a predetermined wave frequency; each of said port means in said second pair of port means being axially spaced from said transducer element means second surface to provide an acoustical travel length along said second path between each of said port means in said second pair of port means and said second surface of approximately one and one half wavelengths of said predetermined wave frequency.

19. The apparatus of claim 6 wherein said tube comprises a plurality of tube portions, a tube portion being on either axial side of each of said port means;

said transducer element means comprises a right cylindrical ring of piezoelectric material supported in fixed relation to said tube; the outer surface of said ring comprising said transducer element means first vibratile surface and the inner surface of said ring comprising said transducer element means second vibratile surface;

a plurality of longitudinal ribs spaced in equal arcuate increments about each said port means in said first and second pair of port means to support in fixed relation said tube portions on either side of each of said port means.

20. The apparatus of claim 19 wherein said tube comprises first and second sections; said first section being concentric with and contiguous to a first longitudinal end of said ring and said second section being concentric with and contiguous to a second longitudinal end of said ring;

a first cylindrical bracket being affixed to said first section and said first end of said ring; a second cylindrical bracket being affixed to said second section and said second end of said ring.

21. The apparatus of claims 2 or 3 including encapsulation means for encapsulating each said transducer element means for protection from the transducer element means environment.

22. The apparatus of claim 19 wherein said tube comprises first and second concentric longitudinal sections each having first and second axial ends;

a cylindrical collar concentric with said tube being affixed at a first of its axial ends to an axial end of said first tube section and affixed at the second of its axial ends to an axial end of said second tube section;

means for securely supporting said ring in said collar;

said collar having a substantially annular port substantially coextensive with said ring outer surface to provide substantially complete acoustical coupling between said ring outer surface and the external transmission medium.

23. The apparatus of claim 13 wherein said ring has a plurality of arcuately spaced electrodes affixed to said inner surface; said cavity baffle means comprises partition means positioned relative said ring inner surface to partition and isolate in chordal directions at least one of said electrodes from the other electrodes and provide a substantially acoustically unobstructed longitudinal path between said electrodes and said port means in said interior paths.

24. The apparatus of claim 23 wherein said partition means is for partitioning and isolating in chordal directions each of said electrodes from each of the other electrodes.

25. The apparatus of claim 24 wherein said partition means comprises two substantially rigid outer layers separated by an intermediate pressure release layer for reducing acoustical wave transmission.

26. The apparatus of claim 23 wherein there are four electrodes, each said electrode covering substantially one quadrant of said inner surface; said partition means having an X-shaped transverse cross section and having four longitudinal edges parallel to said axis; said partition means edges being contiguous with arcuate spacings between said electrodes.

27. The apparatus of claim 15 wherein said folded wave baffle means comprises a wave guide having a transverse acoustic wave blocking rim having inner and outer perimeters and being affixed at its outer perimeter to the inner wall of said tube between said second vibratile surface and said one of said port means; a duct having first and second open ends being affixed at said duct first end to said inner perimeter and extending beyond said one port means and towards said tube first end whereby acoustical wave travel between said second surface and said one port means is folded over said second end of said duct.

28. The apparatus of claim 16 wherein said phase shift means comprises a reflecting surface on at least one of said tube first and second ends; said baffle means for causing acoustical waves in said interior path to be reflected from said reflecting surface;

said reflecting surface having an acoustical impedance surface for adjusting the phase and amplitude of acoustical waves reflected therefrom.

29. The apparatus of claim 14 wherein said phase shift means comprises at least one acoustical wave filter means; said filter means comprising at least a first perforated plate having perforations fitted inside said tube in at least one of said interior paths transversely to said axis; said perforations being sufficiently small to present an acoustical mass to an acoustical wave having a nominal frequency in the operational bandwidth of the transducer but sufficiently large to present a relatively small acoustical resistance to said wave so that the mass reactance component of said perforations predominates over the resistive component whereby said plate acts as an acoustical low pass filter having a predetermined phase shift at said frequency.

30. The apparatus of claim 29 wherein said plate is axially positioned between said transducer element means and one of said port means.

31. The apparatus of claim 29 wherein said filter means includes a perforated second plate fitted inside said tube in said at least one interior path transversely to said axis: said second plate being axially spaced from said first plate a predetermined fraction of a wavelength corresponding to an acoustical wave having a nominal frequency in the transducer operational frequency band to form an acoustically compliant chamber between said plates that provides an acoustical compliance whereby the acoustical energies in said acoustical masses and chamber act like lumped circuit elements.

32. The apparatus of claim 31 including perforated third plate fitted inside said tube in said at least one interior path transversely to said axis; said third plate being axially spaced from said second plate a predetermined fraction of said wavelength whereby said second plate is axially between said first and third plates and axially spaced therefrom by said predetermined fraction, a second acoustically compliant chamber being formed between said second and third plates and acting in the manner of said first chamber.

33. The apparatus of claim 32 wherein said predetermined fraction is substantially equal to or less than one eighth of said wavelength.

34. The apparatus of claim 9 including phase shift means for controlling the phase of acoustical waves in said interior transmission paths;

said phase shift means comprising a first acoustical filter section being between said first port means in said first and second port means pairs; said first filter section comprising first, second, and third axially spaced planar perforated plates each having perforations mounted transversely to said axis in said tube, the axial spacing between consecutive plates in said filter section being a predetermined fraction of a wavelength corresponding to a nominal frequency in the operational frequency band of said transducer; a second filter section substantially indentical to said first filter section; said second filter section being axially positioned between said second port means in said first and second port means pairs;

said perforations in each of said plates being sufficiently small to present a predetermined acoustical mass to an acoustical wave having a nominal frequency in the operational bandwidth of the transducer and sufficiently large to present a relatively small acoustical resistance to said wave so that the mass reactance component of said perforations predominates over the resistive component whereby said phase shift means act as a low pass filter having a predetermined phase shift at said frequency;

adjacent plates in each of said first and second filter sections being axially spaced a predetermined fraction of a wavelength corresponding to an acoustical wave having a nominal frequency in the transducer operational frequency bandwidth to form an acoustically compliant chamber between said said adjacent plates that provides an acoustical compliance whereby the acoustical energies in said acoustical masses and chamber act like lumped circuit elements.

35. The apparatus of claim 34 wherein said first filter section controls the phase shift of said acoustical wave between said first port means and said second filter section controls the phase shift of said acoustical wave between said second port means.

36. The apparatus of claim 34 or 35 wherein each of said perforated plates has a total area of perforations that is approximately 40% of the area defined by the plate perimeter.

37. The apparatus of claim 13 wherein said ring has first and second open ends and an end to end axis; said cavity baffle means comprises a substantially acoustically nontransmissive longitudinally aligned partition for isolating inner wall segments of said ring from one another in a chordal direction in a plane transverse to said axis; said partition being open at its longitudinal ends for acoustical wave travel longitudinally of said partition.

38. Phased array transducer apparatus for receiving or transmitting an acoustic wave in a transmission external medium comprising:

electroacoustic transducer means for converting between acoustic and electrical signals;

said transducer means having first and second vibratile surfaces;

tube means having first and second ends, an end to end axis, and an acoustic interior passage; means for supporting said transducer means along said tube means so that said first vibratile surface is acoustically coupled to the transmission external medium and said second vibratile surface is acoustically coupled to said interior passage;

port means comprising at least a pair of first and second ports, each port being formed in said tube means for conducting acoustic waves between said interior passage and the transmission external medium;

said tube means being of a material having a different acoustic characteristic impedance to acoustic waves than said liquid transmission external medium to provide an acoustic transmission path boundary for acoustic waves traveling interiorly of said tube means between said transducer means and said port means; said port in said port means having an acoustic characteristic impedance so that there is provided substantially unattenuated transmission of acoustic waves through said ports;

said first port in said pair of ports being spaced a predetermined distance in a first axial direction from said transducer means and said second port in said pair of ports being spaced a predetermined distance in a second axial direction different from said first direction, so that within a frequency band of transducer operation a reinforcing combination between the acoustic waves impinging upon or radiating from said first and second vibratile surfaces provides maximum radiation of acoustic waves in the transmission external medium or maximum response to acoustic waves in the liquid transmission external medium in a direction broadside said axis.

39. The apparatus of claim 38 including at least one additional electroacoustic transducer means; each said additional transducer means having first and second vibratile surfaces; second means for supporting each said additional transducer means relative said tube means so that said first surfaces are acoustically coupled to said external transmission medium and said second surfaces are acoustically coupled to said interior passage;

said port means comprising a plurality of substantially annular acoustic ports including said first and second annular ports being formed in said tube means;

said transducer means and ports being spaced axially of said tube means in an axial order so that a port alternates in axial order with a transducer means.

40. The apparatus of claim 39 wherein there is a port at each axial end of said axial order of said transducer means and ports.

41. The apparatus of claims 39 or 40 wherein said axial spacing between said transducer means and ports is approximately one half wavelength of an acoustical wave having a nominal frequency in the operational frequency bandwidth of said transducer.

42. Transducer array apparatus for receiving or transmitting in a frequency band of operation an acoustic wave having a predetermined frequency and corresponding wavelength in a transmission external medium comprising:

electroacoustic transducer means for converting between acoustic energy and electrical energy for transmitting or receiving acoustic waves;

said transducer means having first and second vibratile surfaces;

tube means having first and second ends, an end to end axis, and an acoustic interior passage; means for supporting said transducer means at a predetermined axial location along said tube means so that said first vibratile surface is acoustically coupled to the transmission external medium and said second vibratile surface is acoustically coupled to said interior passage;

port means comprising at least a pair of first and second ports, each port being formed in said tube means for conducting acoustic waves between said interior passage and said transmission external medium;

said tube means being of a material having a different acoustic characteristic impedance to acoustic waves than said liquid transmission external medium to provide an acoustic transmission path boundary for acoustic waves traveling interiorly of said tube means between said transducer means and said port means; said ports in said port means having an acoustic characteristic impedance so that there is provided substantially unattenuated transmission of acoustic waves through said ports;

said first port in said pair of ports being spaced a first predetermined distance in a first axial direction from said transducer means and said second port in said pair of ports being spaced a predetermined distance from said transducer means, so that within the frequency band of transducer apparatus operation including said predetermined frequency a reinforcing combination between the acoustic waves impinging upon or radiating from said first and second vibratile surfaces is provided whereby there is a maximum radiation of acoustic waves or maximum response to acoustic waves in the liquid transmission external medium in a direction broadside said axis.

43. The apparatus of claim 42 wherein said transducer means has a pre-deployment state and a deployment state; said interior passage being elongated; supporting means for supporting said transducer means in said tube means for longitudinal movement in said interior passage whereby said transducer means can be stored adjacent said tube means second end in a pre-deployment state and can be longitudinally moved by said supporting means to an intermediate position and supported by said supporting means intermediately of said interior passage in a deployment state.

44. The apparatus of claim 43 including an elongated canister mounted for sliding telescopic movement into and out of said tube means first end; said canister being slidable into said interior passage towards said second end in a pre-deployment state and slidable out of said first end away from said second end in a deployment state; said supporting means being flexible and being connected to said canister whereby as said canister is moved out of said passage, said supporting means become taut and said transducer means is moved to and supported at said intermediate position in said passage.

45. The apparatus of claim 42 wherein one of said predetermined distances is substantially one half of said predetermined wavelength or greater.

46. The apparatus of claim 45 wherein said other predetermined distance is substantially equal to said one predetermined distance in a second axial direction opposite to said first axial direction.

47. The apparatus of claim 42 wherein said other predetermined distance is the spacing along said end to end axis of said tube means of said second port from said transducer means and wherein the effective acoustic length of said interior passage between said second vibratile surface and said second port is of a different acoustic length than said predetermined distance.

48. A method of providing an acoustic array for receiving and/or transmitting acoustic waves having respective predetermined wavelengths in a liquid external medium comprising the steps of:

a first step of converting between electrical signals and first and second acoustic waves out of phase with one another at an active conversion area along a tube having an end to end axis so that said first wave is in acoustic communication with the external medium and said second wave is in acoustic communication with an acoustic wave conducting internal medium within the tube;

a second step of providing an acoustic wave travel path in the internal medium of the tube between said conversion area and at least one acoustic conducting area along the tube; said conducting area for conducting acoustic waves between the internal medium and the external medium and said conducting area being axially spaced apart from said conversion area; the tube being of a material having a different acoustic characteristic impedance to acoustic waves than the external medium to provide an acoustic transmission path boundary for acoustic waves traveling interiorly of the tube between said conversion area and said conducting area;

a third step of providing said acoustic wave travel path between said conversion area and said conducting area with an effective acoustic length so that said first wave at said conversion area and said second wave at said conducting area are substantially in phase and said first and second waves respectively at said conducting area are substantially out of phase.

49. The method of claim 48 wherein said third step comprises phase shift controlling the acoustic waves in said path to provide a plurality of phase shift controlled second acoustic waves between said conversion area and said conducting area.

50. The method of claims 48 or 49 wherein said second step comprises providing at least one passive conducting area on each axial side of said conversion area.

51. The method of claim 48 wherein the conversion area of said first step and the conducting areas of said second and third steps are substantially annular.

52. The method of claim 50 wherein said second step comprises providing a plurality of conducting areas on each axial side of said conversion area.

53. The method of claim 49 wherein said third step comprises folding said path whereby said path is effectively longer than the spacing between said conversion area and at least one conducting area to correspondingly phase shift an acoustical wave in said path.

54. The method of claim 49 wherein said third step comprises reflecting the acoustical wave in said path whereby said path is effectively longer than said spacing between said conversion area and said at least one conducting area to correspondingly phase shift the acoustical wave in said path.

55. The method of claim 49 wherein said third step comprises passing the acoustic wave in said path through at least one perforated plate at a plate situs between said conversion area and said at least one conducting area.

56. The method of claim 49 wherein said second step comprises providing a plurality of passive conducting areas on each axial side of said conversion area; said third step comprises phase shift controlling the acoustical waves in said path to each of said conducting areas 57. The method of claim 56 wherein said third step comprises phase shift controlling the acoustical waves in said second path by passing the acoustic waves in said path through at least one perforated plate at a plate situs between the conducting areas on each side of said of conversion area.

58. The method of claims 56 or 57 wherein said third step comprises passing the acoustic waves in said path through a plurality of perforated plates at each plate situs.

59. The method of claim 52 wherein said third step comprises phase shift controlling the acoustical waves in said path by providing a low pass acoustical filter that substantially reduces the phase shift of the acoustical waves in said path between each said conducting area and said conversion area.

60. The method of claims 48 or 49 including a fourth step of isolating predetermined portions of said second acoustical wave in said path in said conversion area from one another in a plane transverse to said axis to improve acoustical pressure gradient of acoustical waves in conversion area.

61. The method of claim 48 wherein said first step comprises converting between electrical signals and acoustic waves at a plurality of active areas.

62. The method of claim 61 wherein said first step and third step are performed at alternate axially spaced locations of said tube.

* * * * *

UNITED STATES PATENT AND TRADEMARK OFFICE

CERTIFICATE OF CORRECTION

PATENT NO. : 4,546,459

DATED : October 8, 1985

INVENTOR(S) : John C. Congdon

It is certified that error appears in the above—identified patent and that said Letters Patent is hereby corrected as shown below:

Title page, first column, in paragraph entitled "[56] References Cited", l. 15 for "Gansfors" read --Granfors--;
Title page, second column, in paragraph entitled "OTHER PUBLICATIONS", l. 2 for "Life Books" read --Iliffe Books Ltd.--;
Col. 1, l. 36 for "multielemement" read --multielement--;
Col. 1, l. 63 for "require" read --requires--;
Col. 7, l. 6 for "arrray" read --array--;
Col. 11, l. 53 for "electrodes" read --electrode--;
Col. 14, l. 3 after "number" insert --of--;
Col. 24, l. 56 for "passed" read --phased--;

Signed and Sealed this

*Seventeenth* Day of *June 1986*

[SEAL]

*Attest:*

DONALD J. QUIGG

*Attesting Officer*

*Commissioner of Patents and Trademarks*